US008099907B2

(12) United States Patent
Balbo Di Vinadio

(10) Patent No.: US 8,099,907 B2
(45) Date of Patent: Jan. 24, 2012

(54) METHOD FOR MOUNTING A DRIVE ASSEMBLY FOR DOOR AND WINDOW FRAMES

(75) Inventor: Aimone Balbo Di Vinadio, Chiusa San Michele (IT)

(73) Assignee: SAVIO S.p.A., Chiusa San Michele (Torino) (IT)

( * ) Notice: Subject to any disclaimer, the term of this patent is extended or adjusted under 35 U.S.C. 154(b) by 917 days.

(21) Appl. No.: 11/762,703

(22) Filed: Jun. 13, 2007

(65) Prior Publication Data

US 2008/0007071 A1 Jan. 10, 2008

(30) Foreign Application Priority Data

Jun. 15, 2006 (IT) ..... TO2006A0434

(51) Int. Cl.
*E06B 3/00* (2006.01)

(52) U.S. Cl. ..... 49/506; 49/192; 49/193; 292/32; 292/43

(58) Field of Classification Search ..... 49/192, 49/193, 382, 400, 506; 292/32, 38, 42, 43, 292/141, 145, 150; 411/393, 387.1–387.8
See application file for complete search history.

(56) References Cited

U.S. PATENT DOCUMENTS

| | | | | | |
|---|---|---|---|---|---|
| 2,479,730 | A | * | 8/1949 | Dewar | 411/387.4 |
| 2,654,284 | A | * | 10/1953 | Schevenell | 411/387.4 |
| 2,840,201 | A | * | 6/1958 | Anderson | 52/217 |
| 3,156,152 | A | * | 11/1964 | Reed | 411/386 |
| 3,517,581 | A | * | 6/1970 | Stokes et al. | 411/387.8 |
| 4,538,947 | A | * | 9/1985 | Burkholder | 411/393 |
| 4,541,200 | A | * | 9/1985 | Gartner | 49/192 |
| 4,624,075 | A | * | 11/1986 | Vigreux | 49/192 |
| 4,637,165 | A | * | 1/1987 | Schneider | 49/192 |
| 5,076,015 | A | * | 12/1991 | Manzalini | 49/192 |
| 5,226,256 | A | * | 7/1993 | Fries et al. | 49/13 |
| 7,017,301 | B2 | * | 3/2006 | Balbo Di Vinadio | 49/192 |

FOREIGN PATENT DOCUMENTS

| | | |
|---|---|---|
| EP | 1 227 207 | 7/2002 |
| EP | 1 447 505 | 8/2004 |

OTHER PUBLICATIONS

EP Search Report, Application No. EP07 10 8481, dated Sep. 28, 2007.

* cited by examiner

*Primary Examiner* — Michael Carone
*Assistant Examiner* — Catherine A Kelly
(74) *Attorney, Agent, or Firm* — Patterson & Sheridan, L.L.P.

(57) ABSTRACT

A method for mounting a drive assembly on a door or window frame, comprising the steps of: mounting at least one actuating member and at least one transmission rod in at least one slot of the frame and mutually fastening the actuating member and the transmission rod by a screw that engages a through hole formed in the transmission rod. The through hole is formed in the transmission rod after mounting the actuating member and the transmission rod in the slot.

8 Claims, 31 Drawing Sheets

METHOD FOR MOUNTING A DRIVE ASSEMBLY FOR DOOR AND WINDOW FRAMES

CROSS-REFERENCE TO RELATED APPLICATIONS

This application claims benefit of Italian patent application serial number TO2006A000434, filed Jun. 15, 2006, which is herein incorporated by reference

BACKGROUND OF THE INVENTION

1. Field of the Invention

The present invention relates to accessories for door and window frames and it pertains to a method for mounting a drive assembly for door and window frames.

2. Description of the Related Art

The method according to the invention can be applied for mounting tilt-and-turn door and window frames or tilt-only or turn-only door and window frames. In the case of tilt-and-turn door and window frames, the drive assembly enables selectively to activate a closed position, a turn opening position and a tilt opening position, under the command of a three-position cremone bolt handle. In the case of turn-only or tilt-only door and window frames, the drive assembly enables to select a closed position and an open position of the door or window frame under the command of a two-position handle.

In the remainder of the description and in the claims, the term "drive assembly" shall mean the set of devices and components that enable to transmit the opening/closing motion from the handle to the various closure elements. The drive assembly for door and window frames comprises at least one actuating member and at least one transmission rod fastened to the drive member.

Door and window frames have variable widths and heights, whilst actuating members are standard components with defined dimensions.

To adapt the actuating members to frames with different dimensions, transmission rods are used which connect various actuating members to each other.

According to the prior art, the lengths of the transmission rods are determined when mounting the drive assembly on the door or window frame. This operation generally requires cutting the transmission rod to measure and drilling holes on the transmission rod for fastening the transmission rod to the actuating members.

Cutting the rods to measure and forming fastening holes on the transmission rods is highly time-consuming. Previously, solutions have been proposed having the purpose of avoiding cutting the transmission rods to measure and forming fastening holes on said rods. Some solutions provide for the use of telescopic rods formed by two mutually sliding parts, able to be fastened in a selected position by means of pressure screws.

However, currently available solutions are not completely satisfactory, as they have several drawbacks.

SUMMARY OF THE INVENTION

The object of the present invention is to provide an improved method for mounting a drive assembly for door and window frames, which enables to overcome the drawbacks of prior art solutions.

According to the present invention, said object is achieved by a method having the characteristics set out in claim 1.

BRIEF DESCRIPTION OF THE DRAWINGS

The present invention shall now be described in detail with reference to the accompanying drawings provided purely by way of non limiting example, in which.

DETAILED DESCRIPTION

Figure 1:
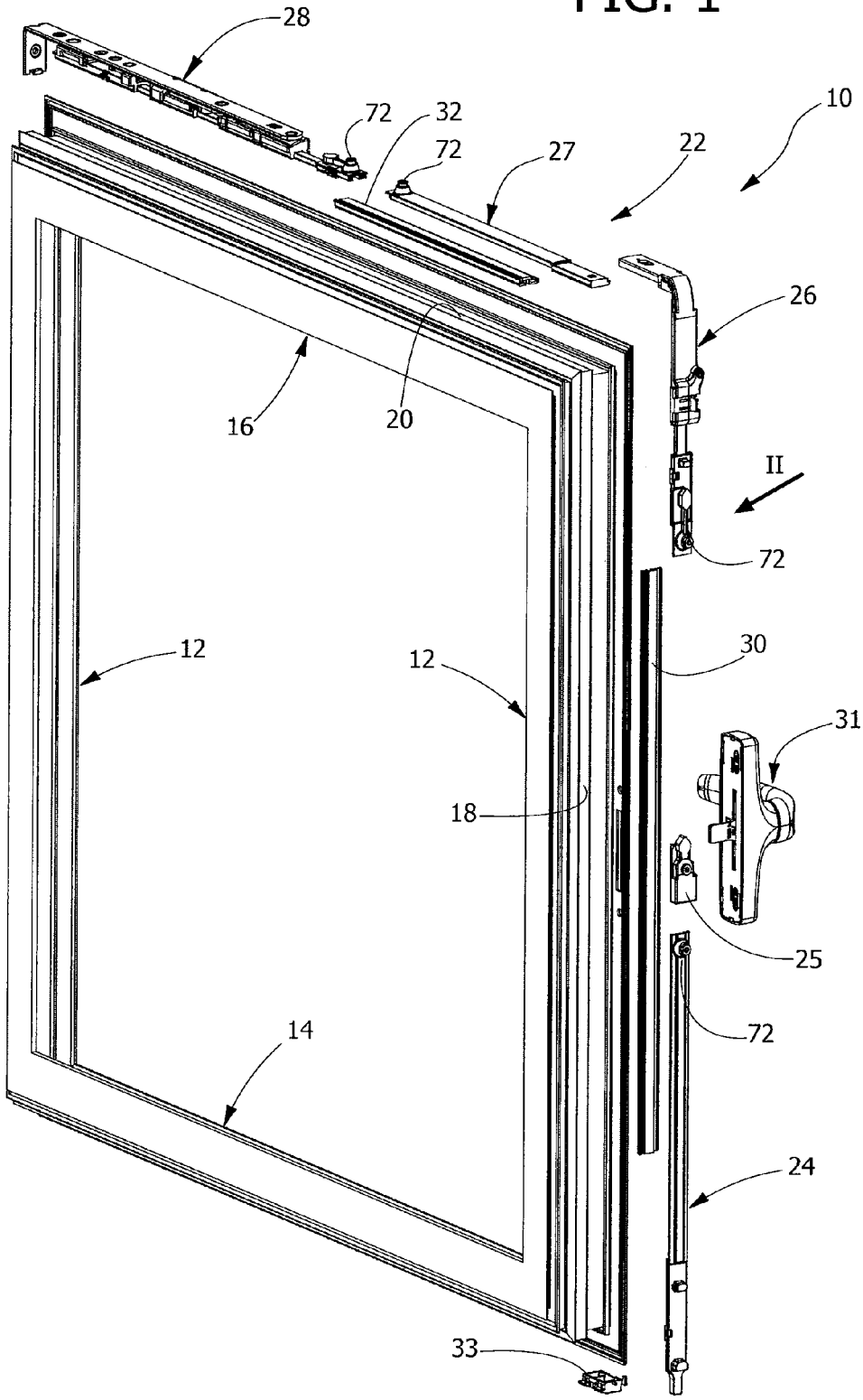
FIG. 1 is an exploded perspective view of a drive assembly for door and window frames associated to the frame of a door or window.

With reference to FIG. 1, the number 10 designates the frame of a tilt-and-turn opening window. The frame 10 comprises two vertical uprights 12 joined together by a lower cross member 14 and by an upper cross member 16. The uprights 12 and the cross members 14, 16 are provided on their outer longitudinal side with slots 18, 20 able to receive the components of a drive assembly that enables to select, by means of a handle, a closed position, a turn opening position and a tilt opening position.

In FIG. 1, the drive assembly is globally designated by the reference 22 and it comprises a plurality of actuating members 24, 25, 26, 27, 28 and a plurality of transmission rods 30, 32. The actuating members shown in FIG. 1 are, respectively, a vertical fulcrum 24, a cremone bolt 25, an angled transmission element 26, a cursor 27 and a scissors arm 28. The frame 10 is also provided with a control handle 31 and with a support block 33. The general structure and the operation of the actuating members 24, 25, 26, 27, 28 are known in themselves and they are outside the scope of the present invention.

Figure 4:
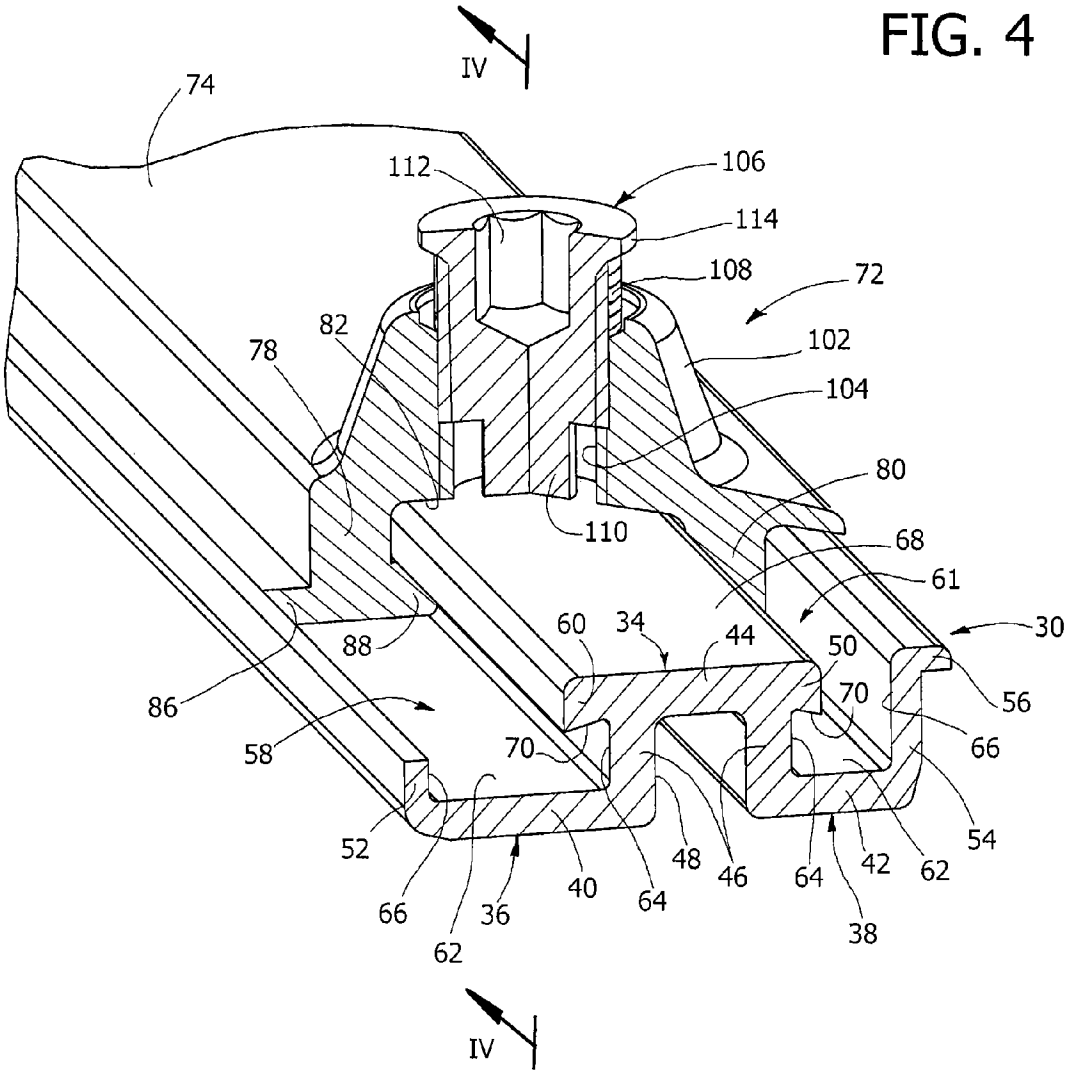
FIGS. 4*a* and 5*a* are sections according to the lines IV-IV and V-V of FIGS. 4 and 5, FIGS. 4*b* and 5*b* are enlarged details of the parts indicated by the arrows IV and V in FIGS. 4*a* and 5*a*, FIGS. 6*a*, 7*a* and 8*a* are sections according to the lines VIa-VIa, VIIa-VIIa and VIIIa-VIIIa of FIGS. 6, 7 and 8, FIGS. 6*b*, 7*b* and 8*b* are sections according to the lines VIb-VIb, VIIb-VIIb, VIIIb-VIII of FIGS. 6, 7 and 8, and FIGS. 9 through 27 are perspective views showing the mounting sequence of the various components of the drive assembly on the door or window frame.
Figure 4B:
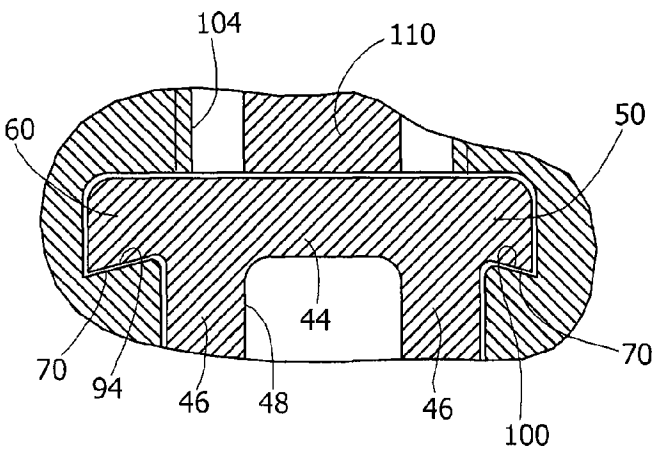
Figure 4A:
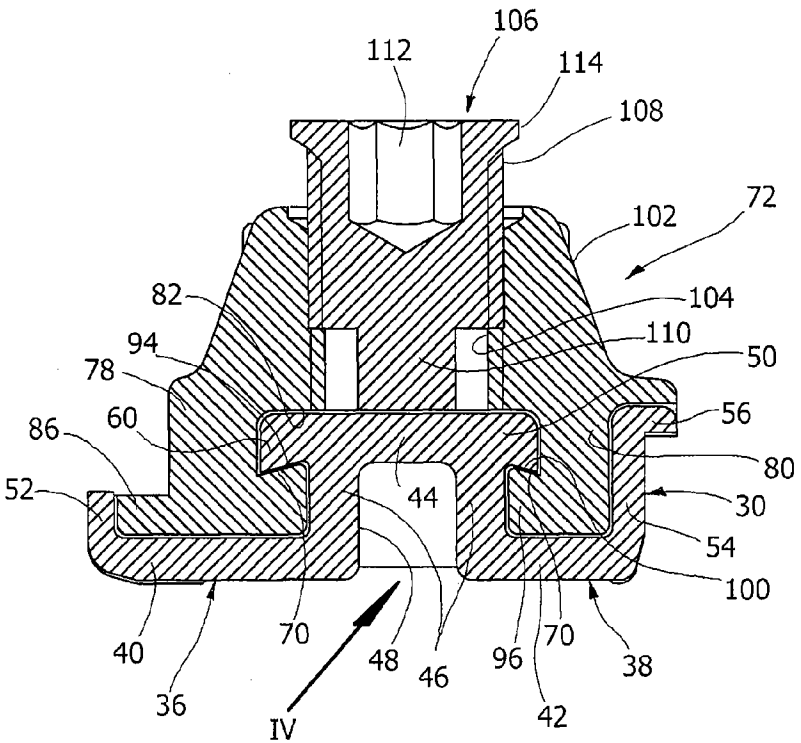

With reference to FIGS. 4 and 4*a*, each transmission rod 30, 32 is constituted by an extruded, drawn or profiled element having constant cross section along its own longitudinal axis.

Each transmission rod 30, 32 comprises a central portion 34 and two lateral portions 36, 38 situated at opposite parts relative to the central portion 34. The two lateral portions 36, 38 have respective mutually co-planar bases 40, 42. The central portion 34 has a base 44 that is parallel and distanced from the bases 40, 42 of the lateral portions 36, 38. The base 44 of the central portion 34 is connected to the respective bases 40, 42 of the lateral portions 36, 38 by means of two longitudinal ribs 46. The base 44 of the central portion 34 and the ribs 46 form a "U" shaped longitudinal groove 48 that extends along the central portion 34 and that separates the two lateral portions 36, 38. The central portion 34 has two lateral extensions 50 and 60 that extend exteriorly beyond the ribs 46. The two bases 40, 42 of the lateral portions 36, 38 have at their outer ends respective longitudinal ribs 52, 54. The height of the rib 52 of the lateral portion 36 is about half the height of the ribs 46. The rib 54 of the lateral portion 38 ends at the same height as the base 44 of the central portion 34 and it has a laterally projecting edge 56.

The two lateral portions 36, 38 form respective channel-shaped guides 58, 61. Each of the two guides 58, 61 has an upper surface 62 and two lateral surfaces 64, 66. The central portion 34 has an upper surface 68 that is parallel to the upper surfaces 62 of the guides 58, 61. The lateral extensions 50, 60 of the central portion 34 have lower surfaces 70 inclined at an acute angle relative to the lateral surfaces 64 of the ribs 46. The thickness of the bases 40, 42 of the lateral portions 36, 38 of the ribs 46 and of the base 44 of the central portion 34 is substantially constant. The rods 30, 32 are preferably made of metallic material (e.g., aluminium alloy) or plastic material (e.g., polyamide).

Figure 3:
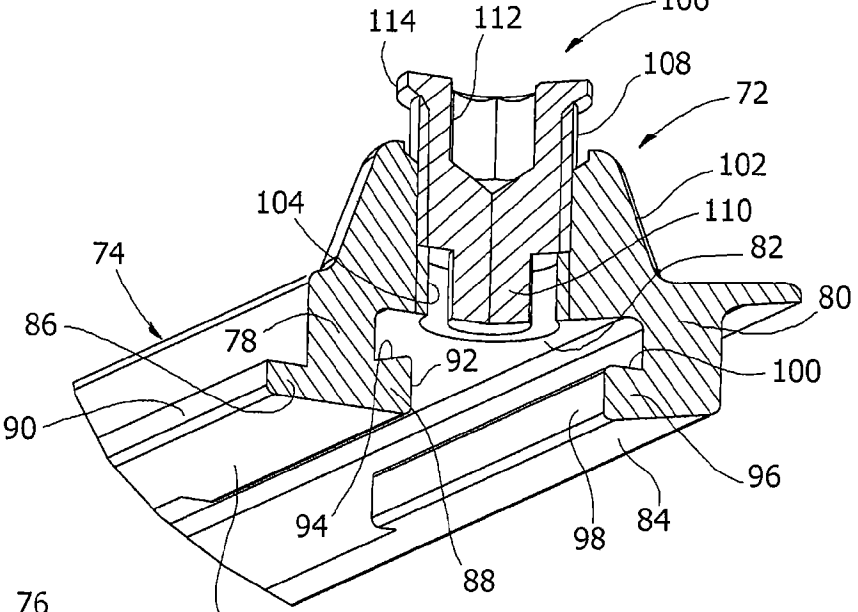
FIG. 3 is a section according to the line III-III of FIG. 2, FIGS. 4 through 8 are perspective views showing the sequence of the fastening operation between an actuating member and a transmission rod.
Figure 2:
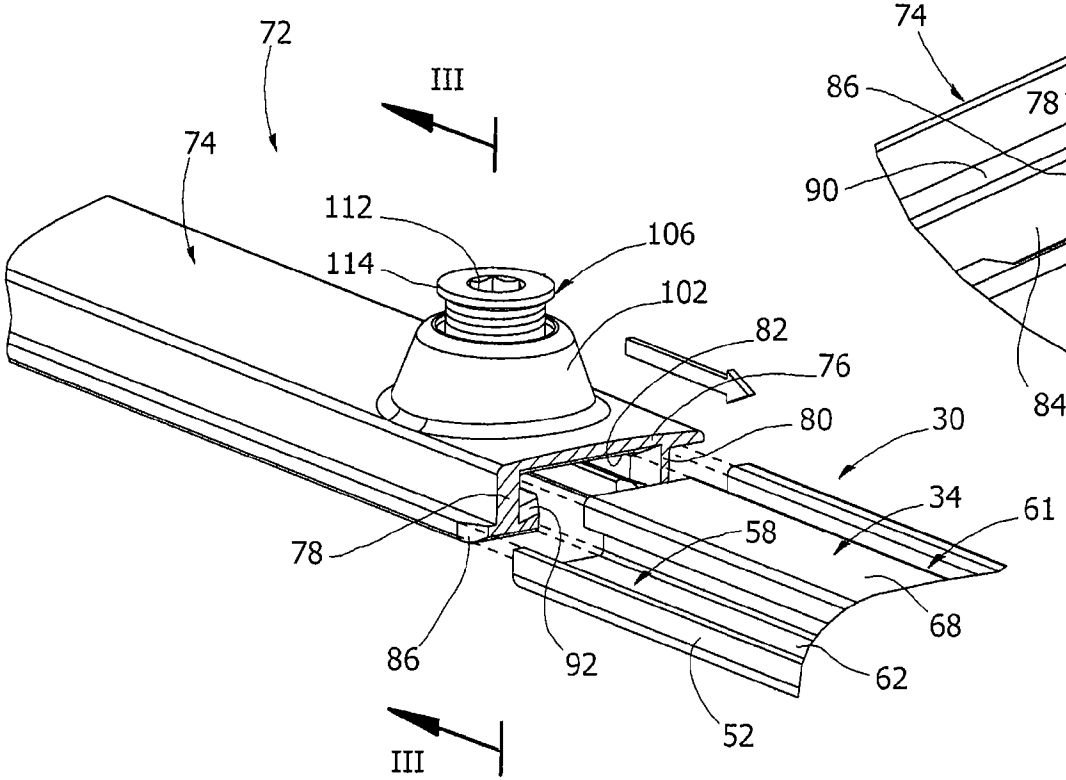
FIG. 2 is a perspective view of the part designated by the arrow 11 in FIG. 1.

With reference to FIG. 1, each actuating member 24, 25, 26, 27, 28 has a coupling portion 72 for coupling with a transmission rod 30, 32. With reference to FIGS. 2 and 3, the coupling portion 72 of each actuating member 24, 25, 26, 27, 28 comprises a body 74 having a base 76 wherefrom project two parallel longitudinal ribs 78, 80. The ends of the longitudinal ribs 78, 80 are shaped in such a way as to establish a sliding coupling in longitudinal direction with the guides 58, 61 of the transmission rod 30, 32.

With reference again to FIGS. 2 and 3, the base 76 of the coupling portion 72 has a flat lower surface 82 wherefrom extend the ribs 78, 80. The lower ends of the ribs 78, 80 have respective coplanar flat surfaces 84, parallel to the flat surface 82. When cross sectioned, the longitudinal rib 78 has at its end an outer lateral extension 86 and an inner lateral extension 88. The two lateral extensions 86, 88 have respective lateral parallel walls 90, 92, orthogonal relative to the surfaces 82, 84. The inner lateral extension 88 has an upper surface 94 inclined at an acute angle relative to the lateral wall 92. The longitudinal rib 80 has, in cross section, an inner lateral extension 96 with a lateral wall 98 parallel to the wall 92 and an upper surface 100 inclined at an acute angle relative to the lateral wall 98.

The coupling portion 72 of each actuating member 24, 25, 26, 27, 28 has a protuberance 102 projecting from the outer surface of the base 76. The protuberance 102 has a threaded through hole 104 with an axis orthogonal relative to the inner surface 82 of the base 76. A screw 106 is engaged in the threaded hole 104. The screw 106 has a threaded body 108 and a tip 110 that projects from the threaded body 108. The tip 110 has a cylindrical lateral wall with a smaller diameter than the diameter of the threaded body 108. The tip ends with a flat wall orthogonal to the longitudinal axis of the screw.

The screw 106 has a hexagonal slot 112 and an arresting edge 114 at one end of the threaded body 108. The length of the threaded body 108 is substantially equal to the length of the threaded hole 104, so that when the screw 106 is completely screwed into the hole 104 the tip 110 projects from the lower surface 82 of the base 76.

With reference to FIGS. 4, 4*a* and 4*b*, the coupling portion 72 of each actuating member 24, 25, 26, 27, 28 couples in telescopic fashion with a corresponding portion of a transmission rod 30, 32. At the moment of the telescopic coupling between a transmission member 24, 25, 26, 27, 28 and a transmission rod 30, 32, the screw 106 is only partially screwed into the hole 104 and the frontal end of the tip is recessed in the hole 104 relative to the lower surface 82 of the coupling portion 72. The coupling portion 72 and the transmission rod 30, 32 are therefore free to slide with respect to one another in longitudinal direction. To allow telescopic sliding between the two components, the respective coupling cross-sections are so dimensioned as to leave a constant play along the entire cross-section, e.g. in the order of 0.1 mm, as shown in particular in FIGS. 4*a* and 4*b*.

The actuating members 24, 25, 26, 27, 28 and the transmission rods 30, 32 are mounted in the respective slots 18, 20 of the frame 10 according to the procedure described below with reference to FIGS. 9 through 27.

Figure 9:
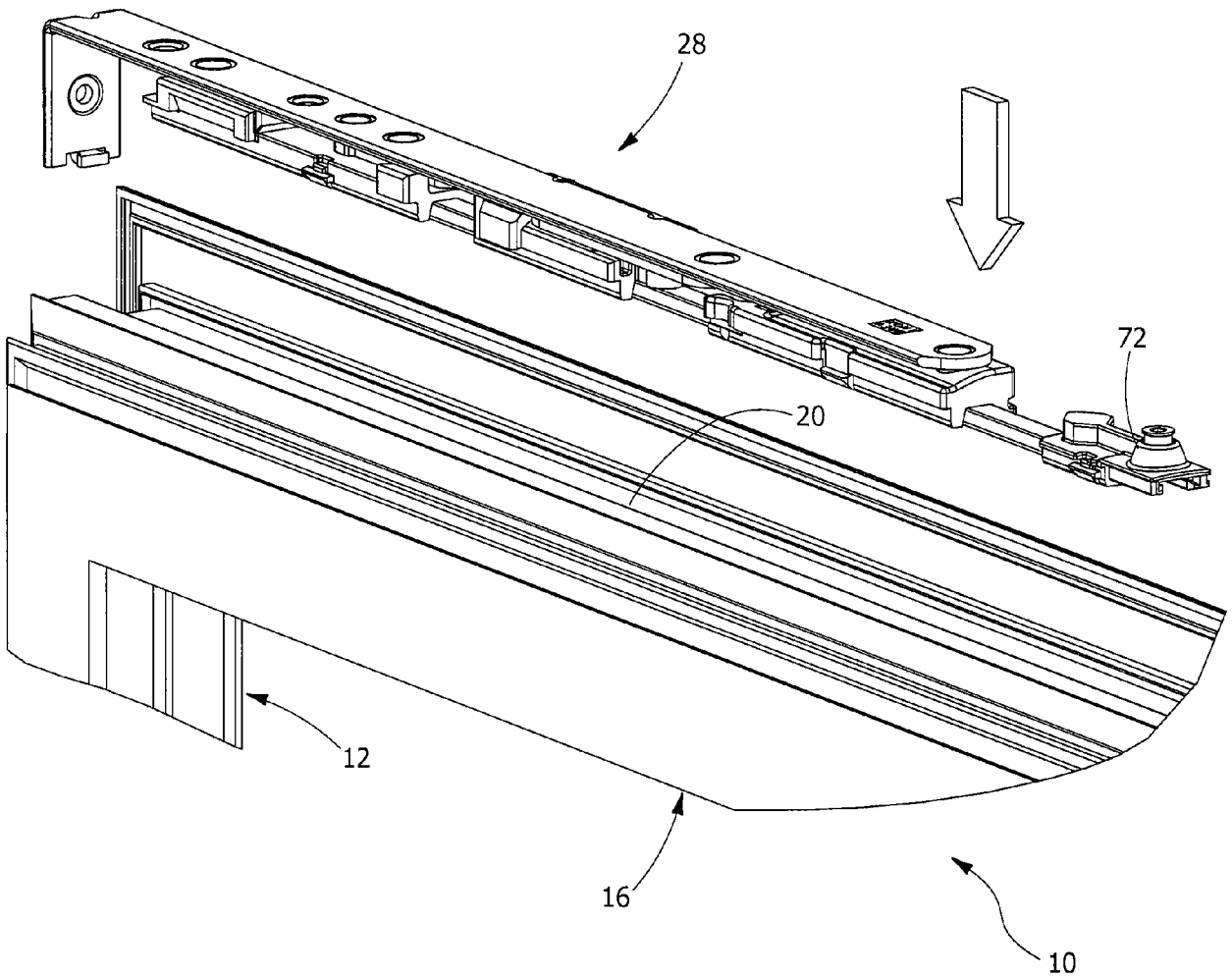
Figure 10:
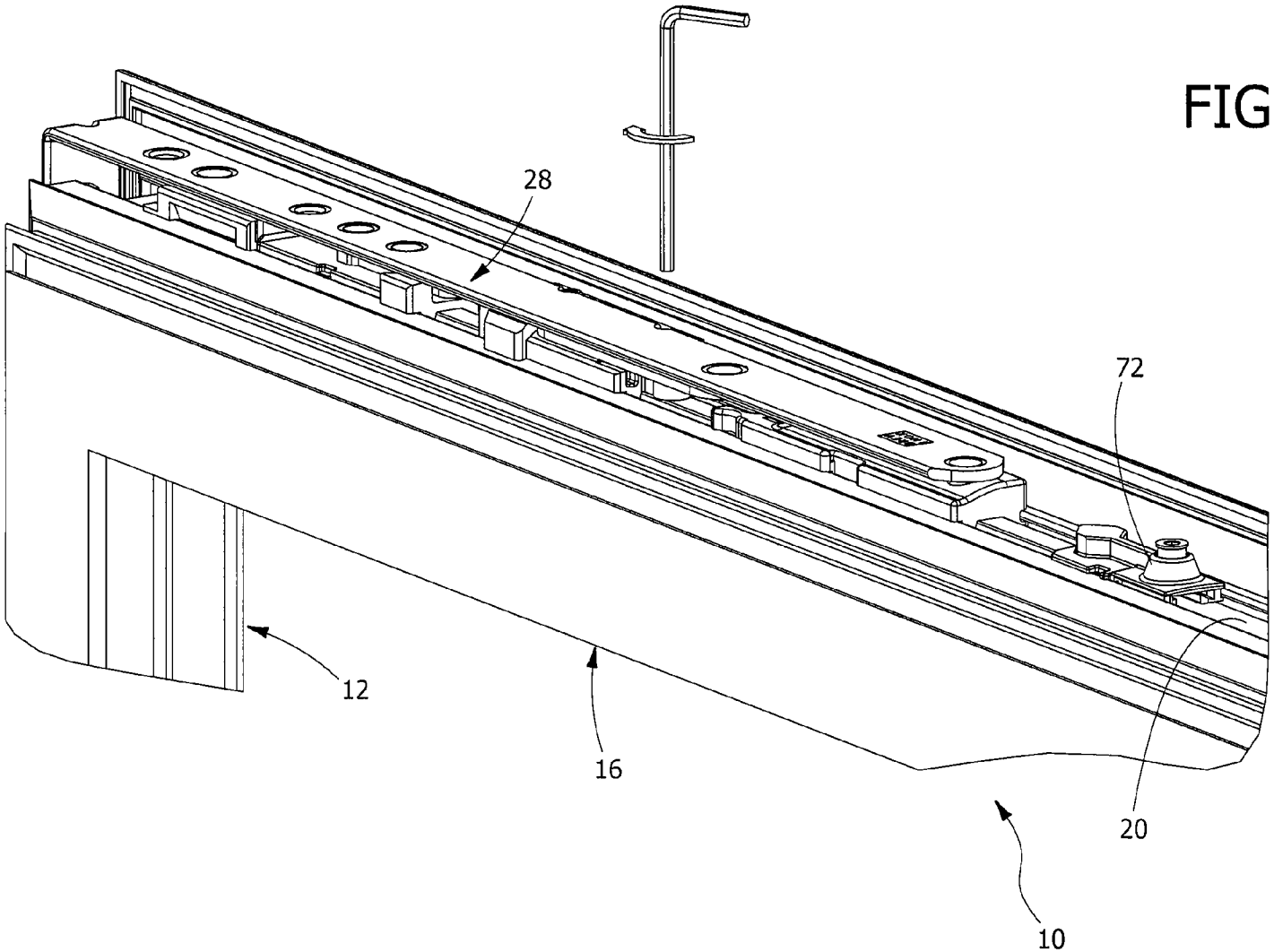

With reference to FIG. 9, the scissors arm 28 is inserted frontally in the direction of the arrow. FIG. 10 shows the scissors arm 28 inserted in the slot 20. After insertion in the slot 20, the scissors arm 28 is positioned and fastened to the frame 10 by means of two dowels (not shown in FIG. 10).

Figure 11:
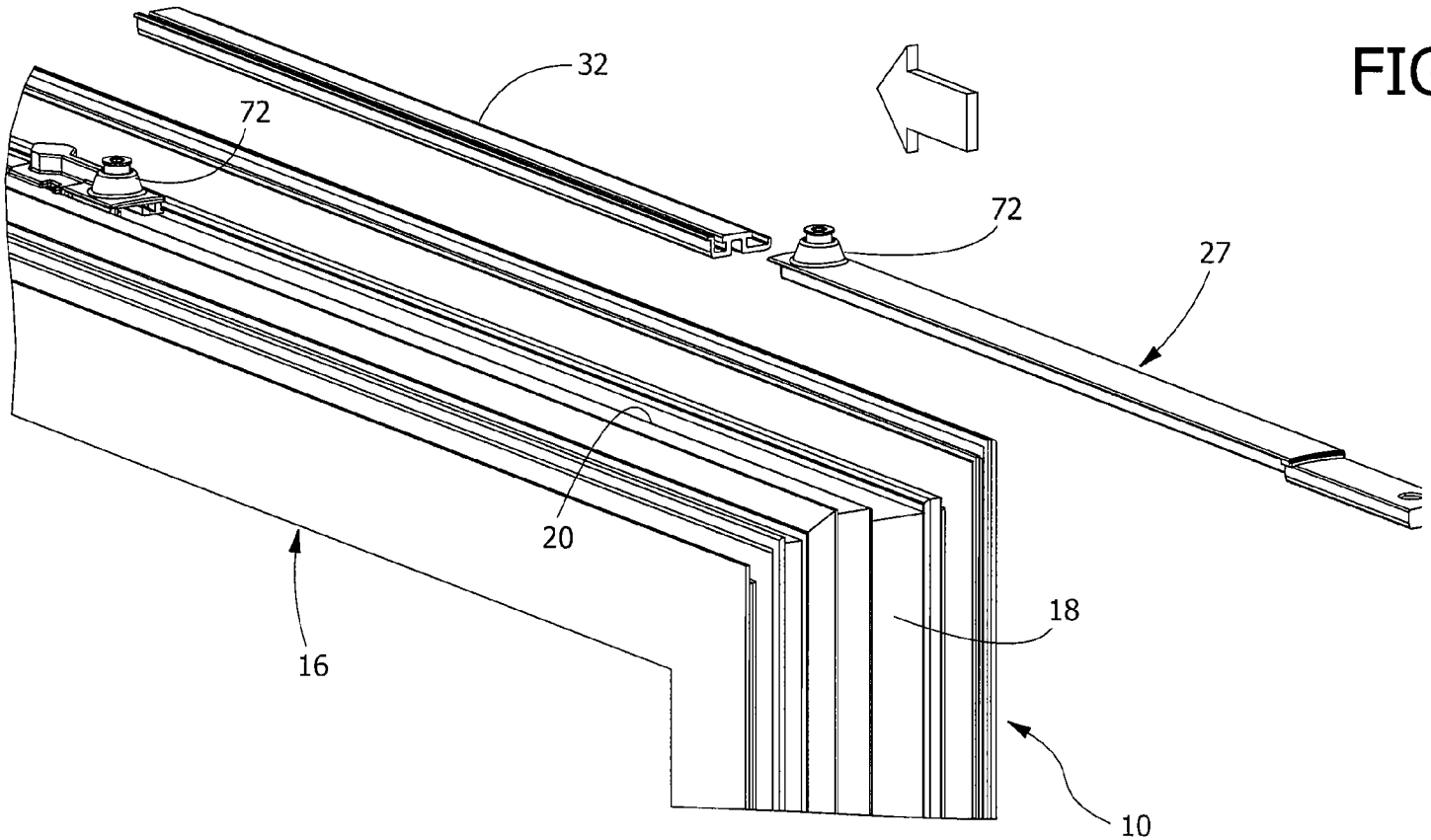
Figure 12:
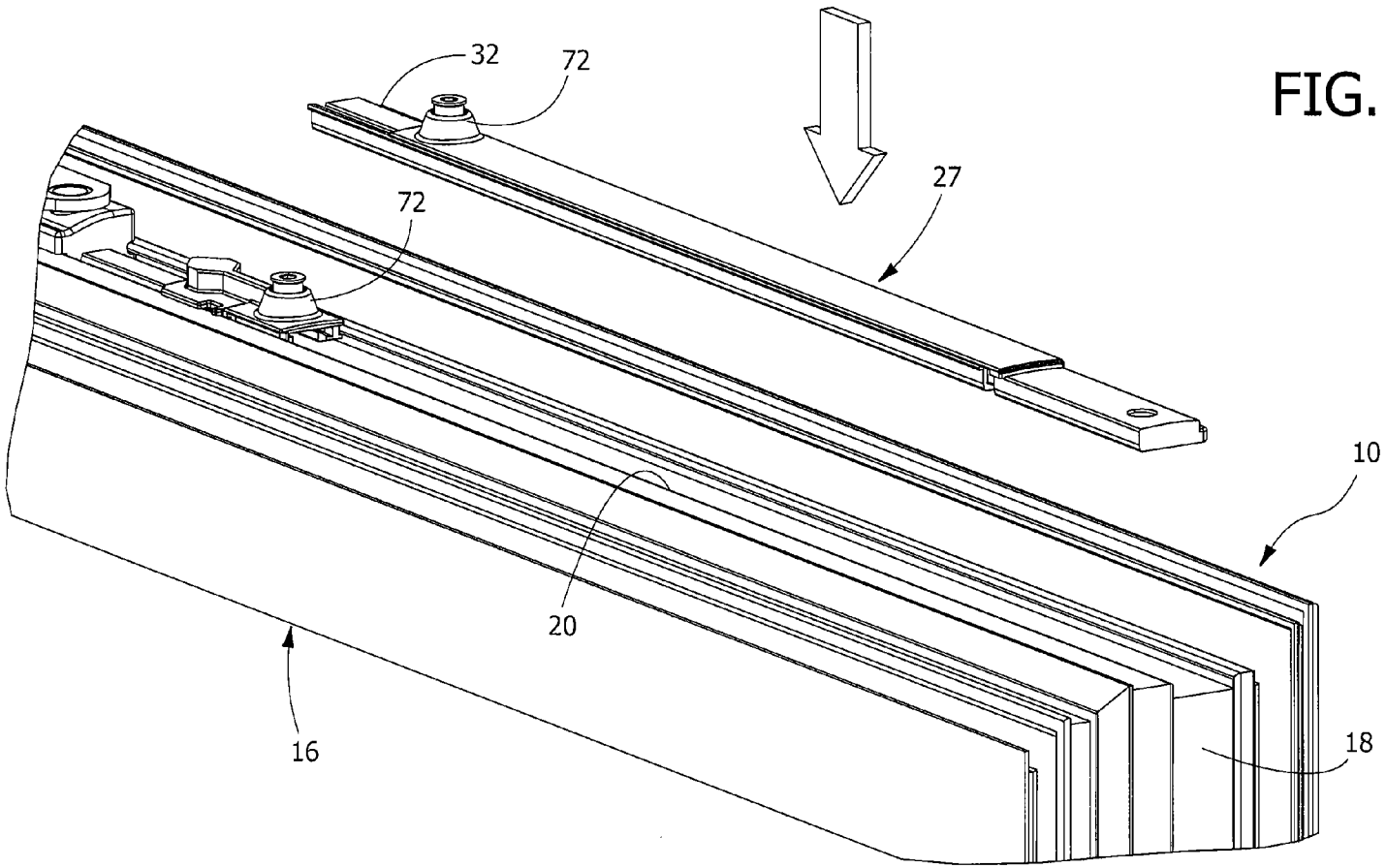

With reference to FIG. 11, the rod 32 is then coupled telescopically to the cursor 27 with a sliding motion in the direction of the arrow. After the telescopic coupling, the rod 32 and the cursor 27 are inserted frontally into the slot 20 in the direction indicated by the arrow in FIG. 12.

Figure 13:
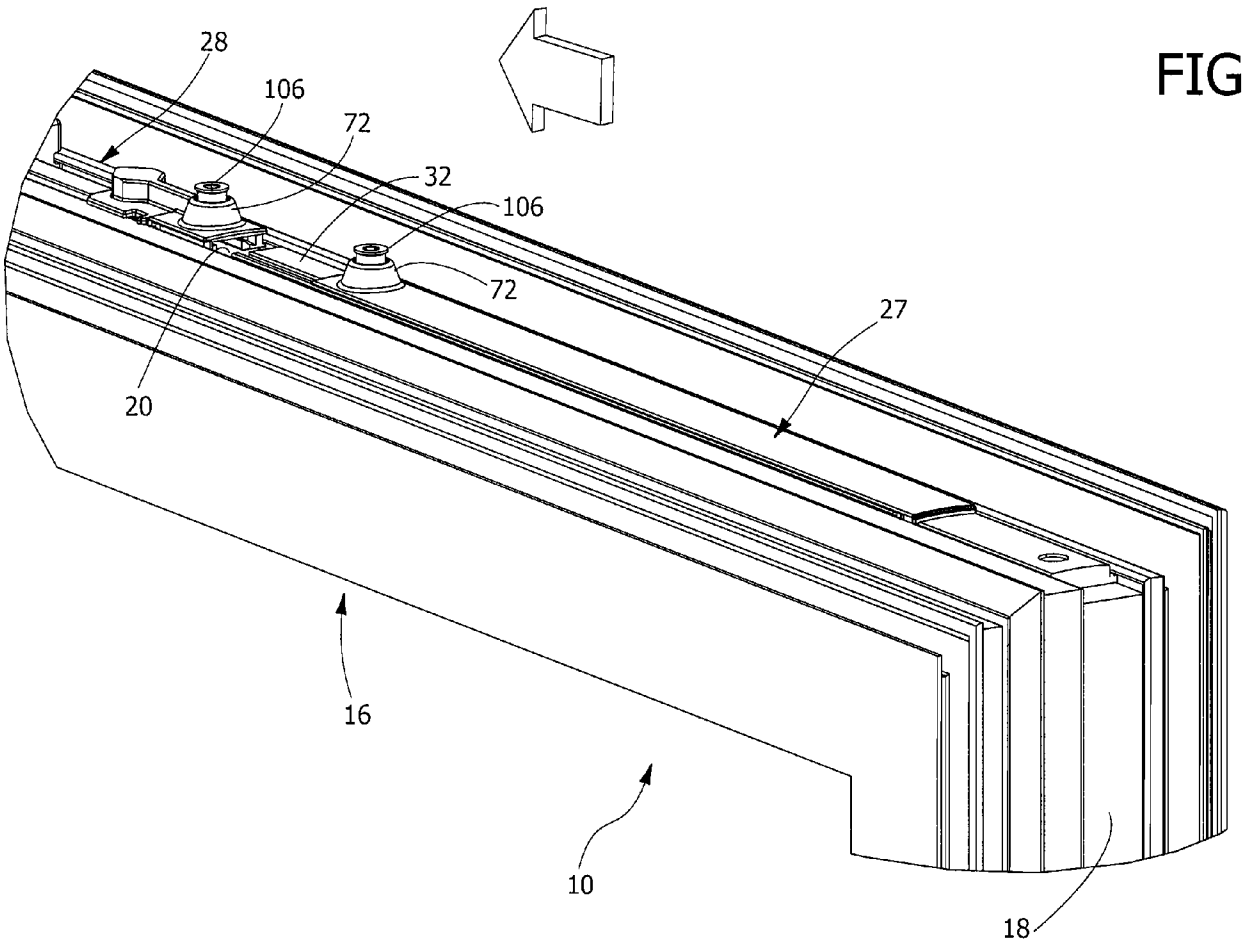
Figure 14:
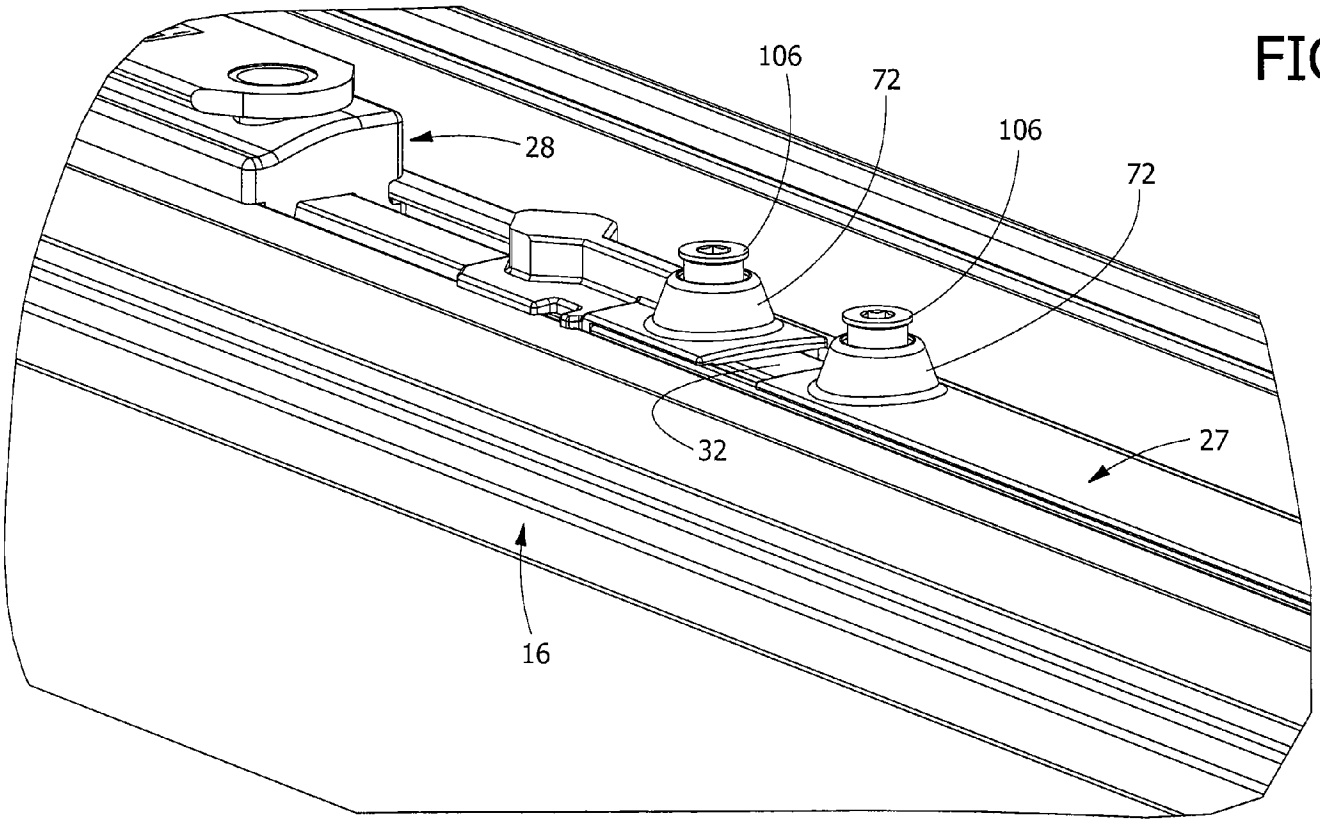

With reference to FIG. 13, after insertion into the slot 20 the rod 32 and the cursor 27 are made to slide in the direction of the arrow. The rod 32 is coupled telescopically with the coupling portion 72 of the scissors arm 28. FIG. 14 shows the configuration in which the rod is coupled with the coupling portion 72 of the scissors arm 28.

Figure 15:
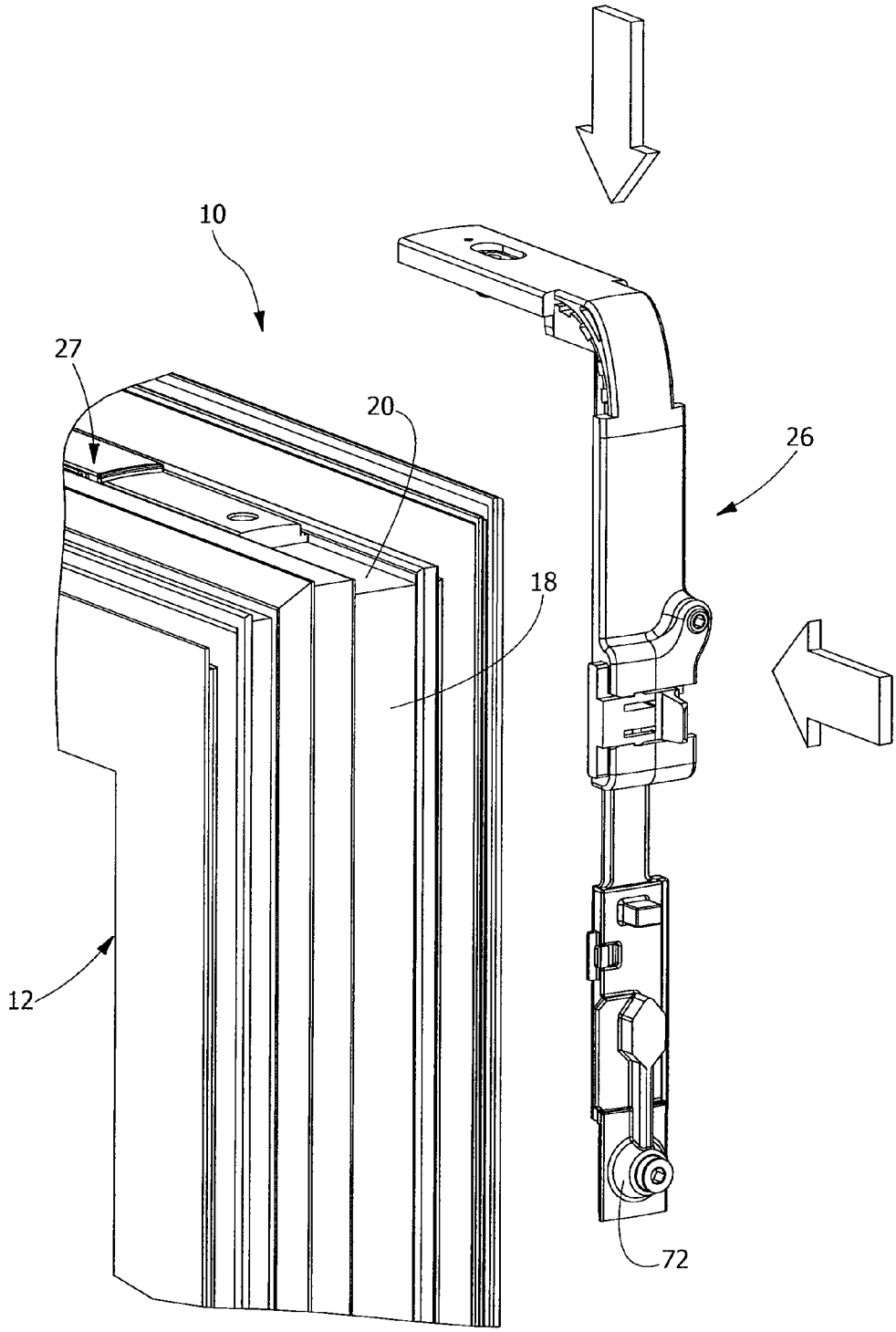
Figure 16:
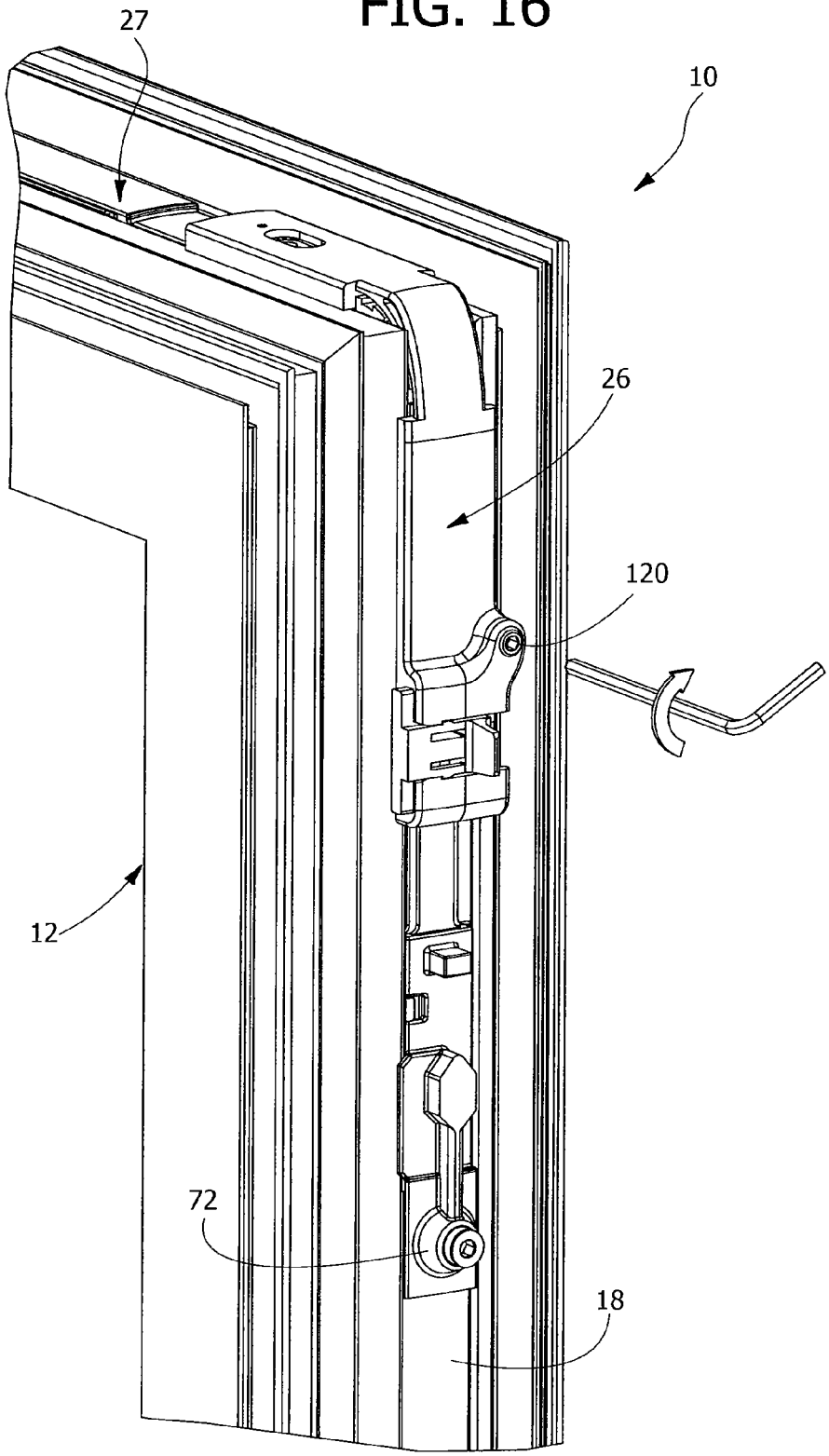

FIGS. 15 and 16 show the mounting on the frame 10 of the angled transmission element 26. The transmission element 26 is first inserted into the slot 18 in the direction indicated by the horizontal arrow. After insertion into the slot 18, the element 26 is made to slide in the direction of the vertical arrow until obtaining the engagement of the transmission element with the cursor 27. After the positioning, the angled transmission element 26 is fastened to the frame 10 by means of a dowel 120.

Figure 17:
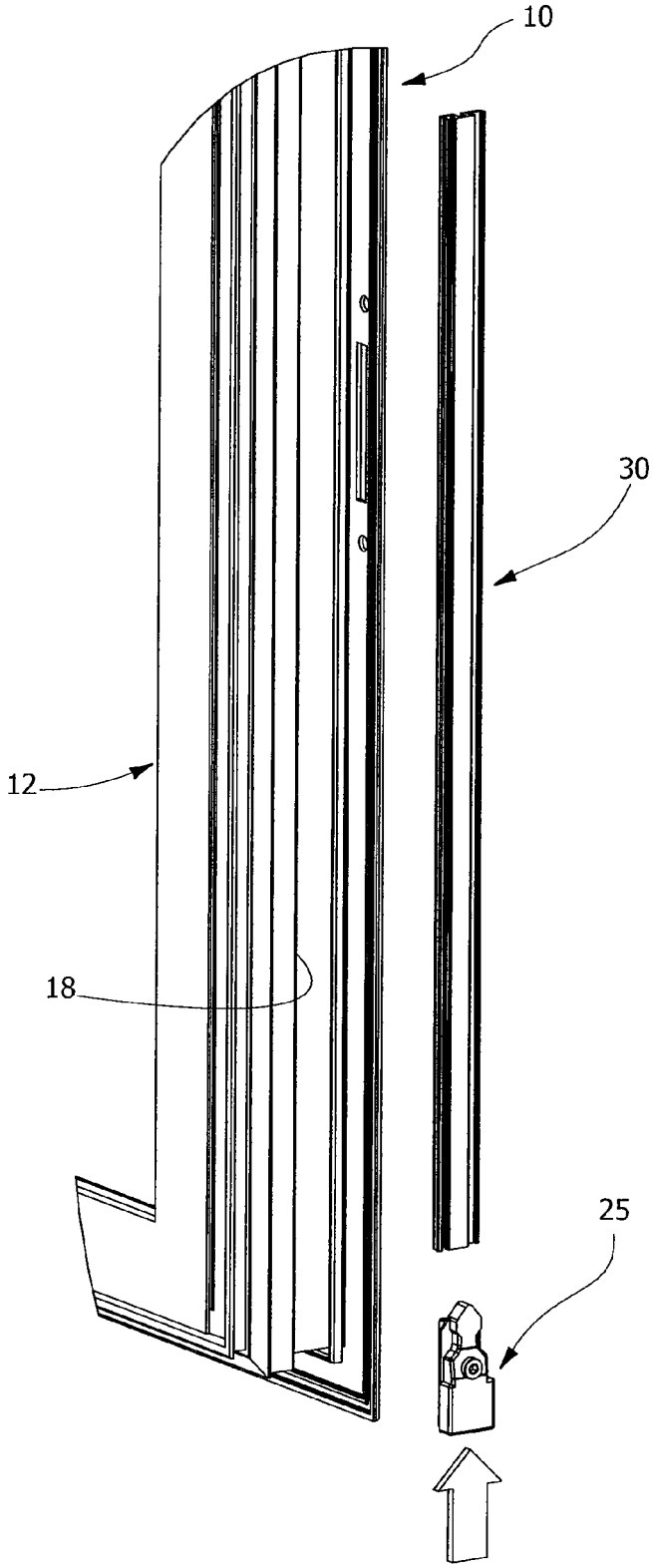
Figure 18:
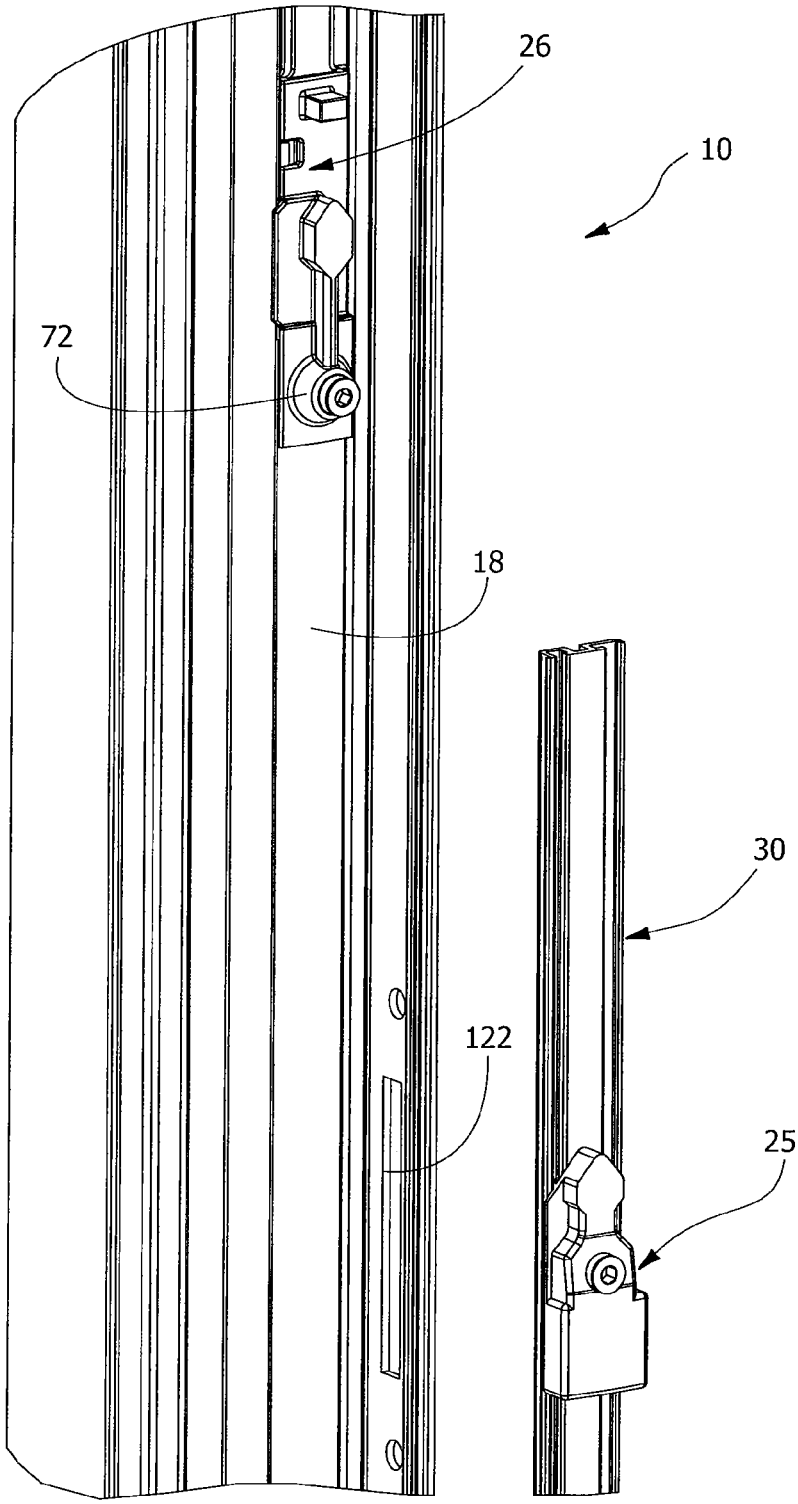

At this point, the components are mounted on the vertical upright 12 of the frame. With reference to FIG. 17, the cremone bolt coupling 25 is inserted on the transmission rod 30 in the direction indicated by the arrow. As shown in FIG. 18, the cremone bolt 25 is positioned in proximity to a cut 122 provided on an edge of the frame 10.

Figure 19:
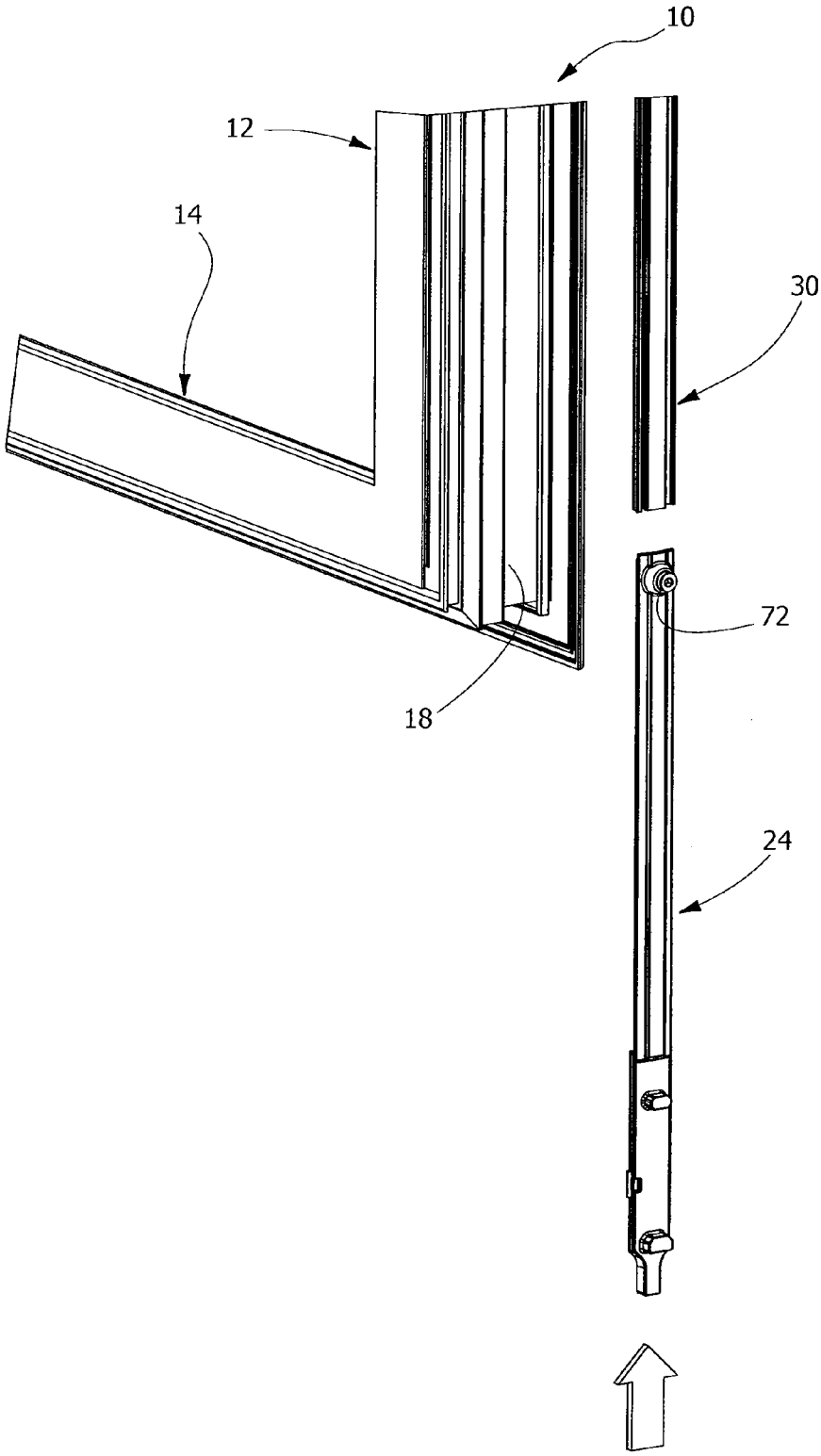
Figure 20:
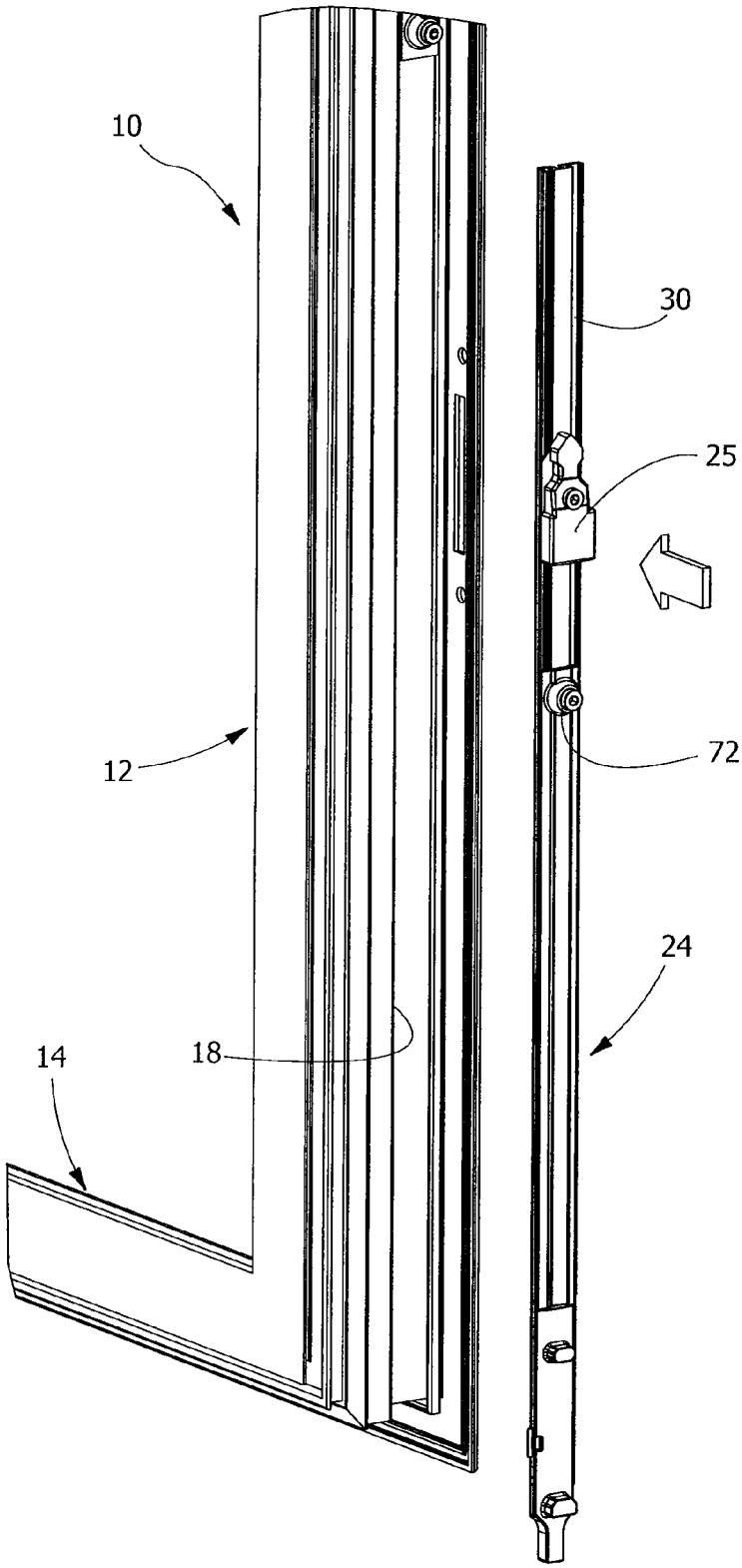

With reference to FIG. 19, the vertical fulcrum 24 is then mounted on the lower end of the rod 30. The rod 30 is coupled telescopically with the vertical fulcrum 24 and it is made to slide all the way (FIG. 20). Hence, the set formed by the rod 30, by the vertical fulcrum 24 and by the cremone bolt 25 is inserted frontally into the slot 18 in the direction indicated by the arrow in FIG. 20.

Figure 21:
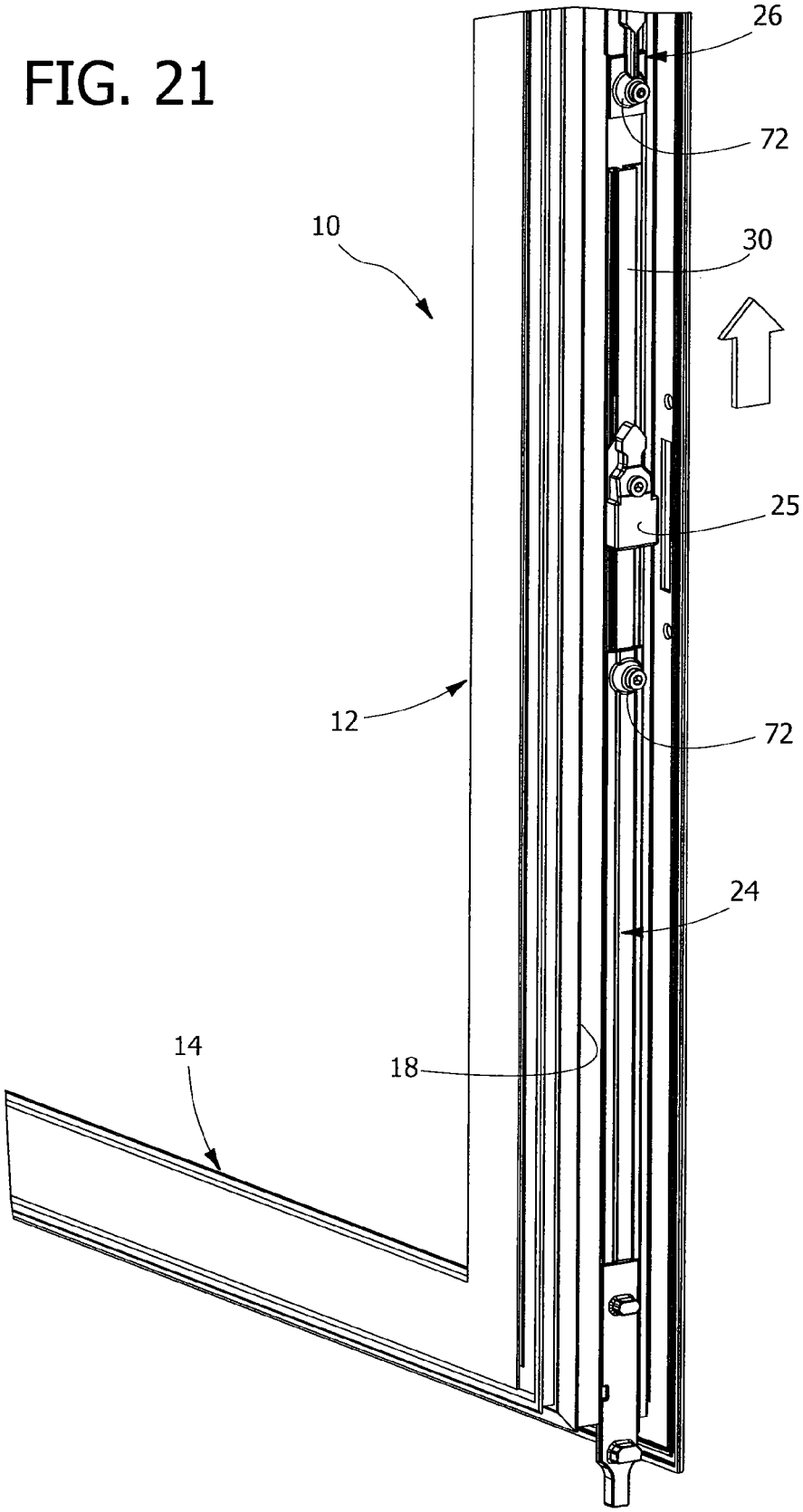
Figure 22:
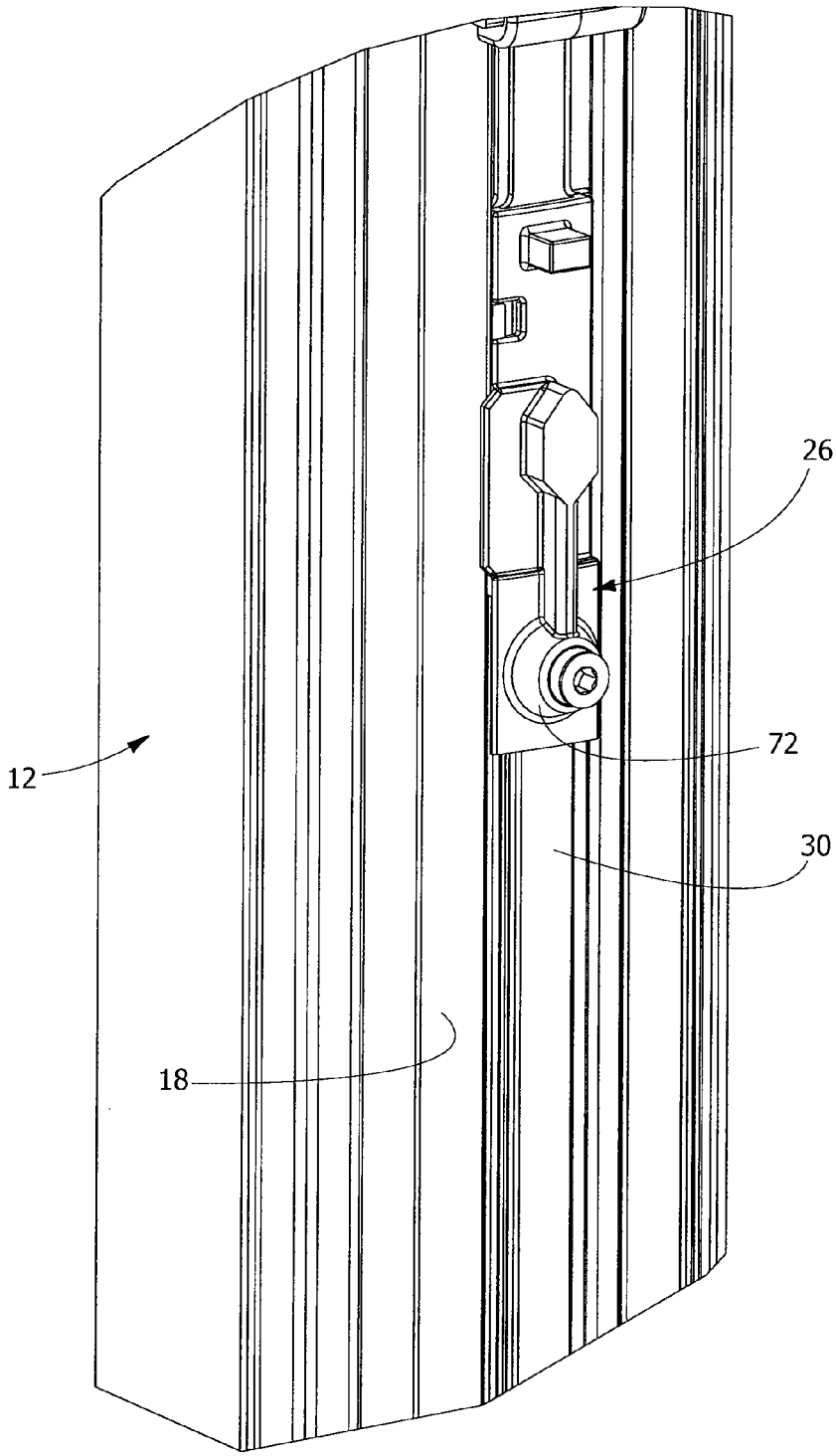

With reference to FIG. 21, after insertion into the slot 18, the rod 30 and the vertical fulcrum 24 are made to slide in the direction of the arrow. The rod 30 is coupled telescopically with the coupling portion 72 of the angled transmission element 26. FIG. 22 shows the rod 30 coupled with the angled transmission element 26.

The frontal insertion of the actuating members 24, 25, 26, 27, 28 and of the transmission rods 30, 32 into the slots 18, 20 is preferably effected as described in European patent application no. 06425586 by the same applicant.

Figure 23:
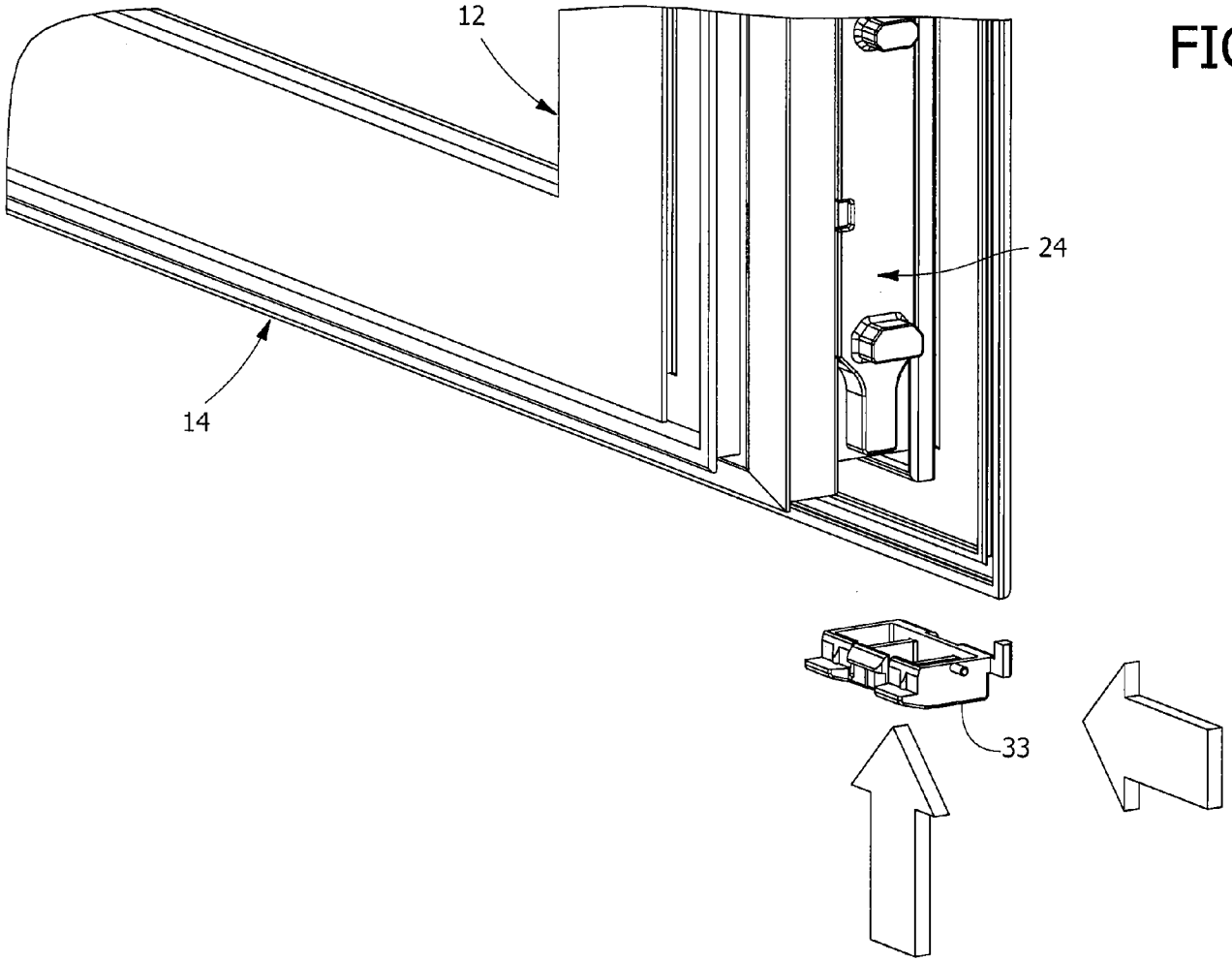
Figure 24:
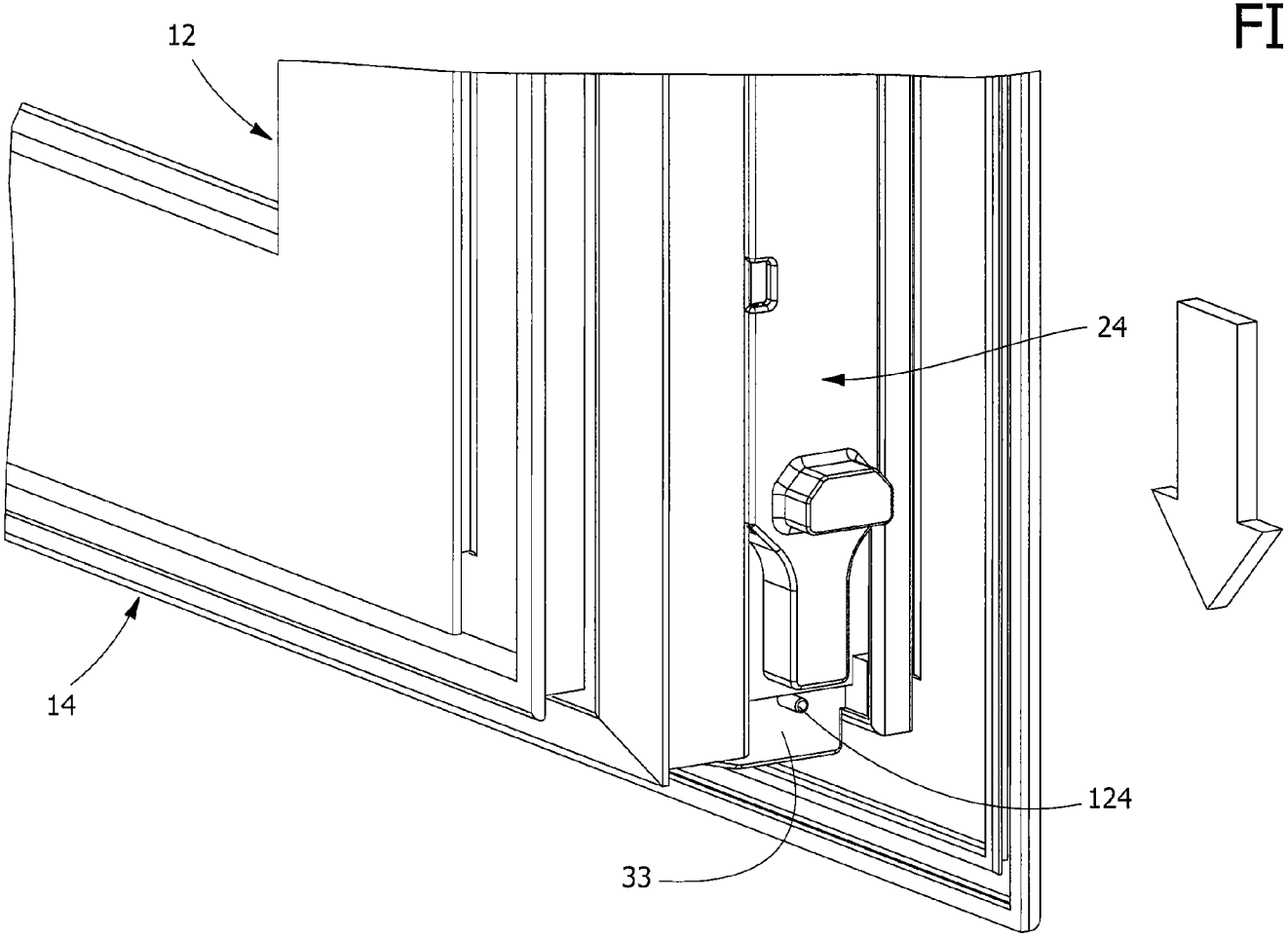

FIG. 23 shows the mounting of the support block 33, which is inserted into the slot of the lower cross member 14 in the directions indicated by the two arrows. The subsequent step is to make the vertical fulcrum 24 slide along the direction of the arrow in FIG. 24 until the vertical fulcrum 24 abuts against a reference 124 of the support block 33.

Figure 25:
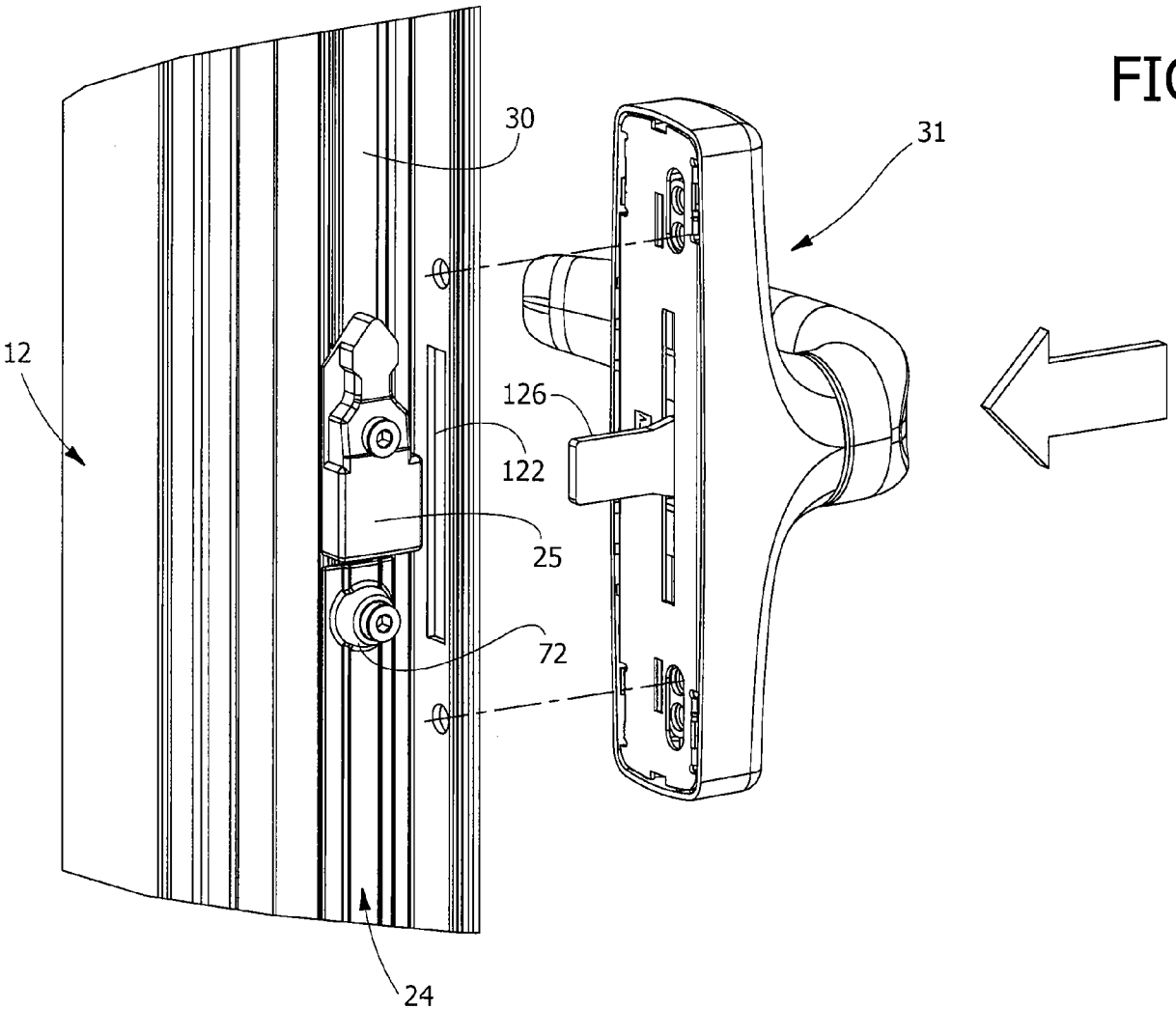
Figure 26:
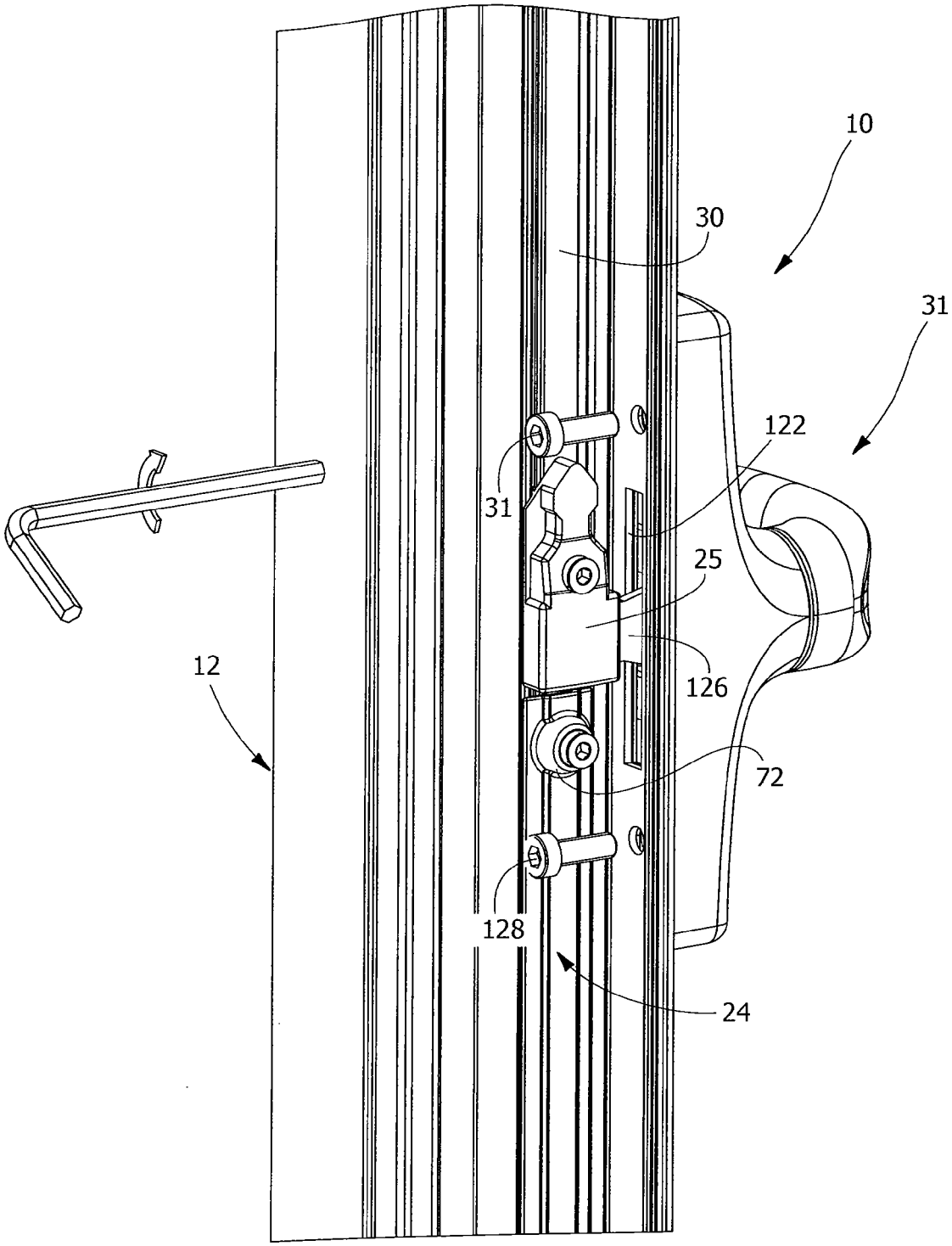

Lastly, the cremone bolt handle 31 is mounted. As shown in FIG. 25, the handle 31 has a control element 126 that is inserted through the cut 122 of the frame 10 and engages the cremone bolt coupling 25. With reference to FIG. 26, the handle 31 is then fastened to the frame 10 by means of two screws 128.

Figure 27:
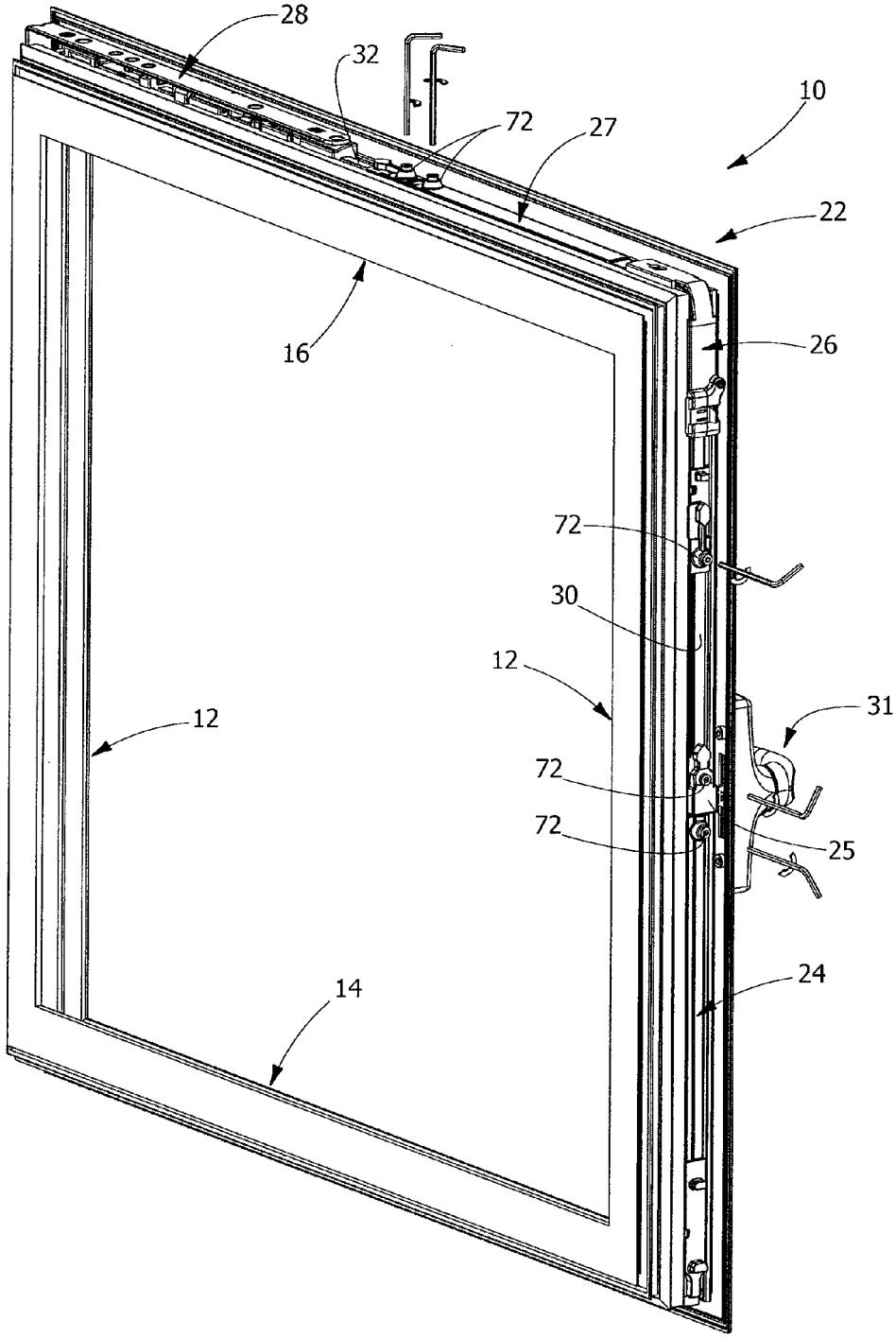

With reference to FIG. 27, after positioning the various components of the drive assembly as described previously, the transmission rods 30, 32 are definitively fastened to the actuating members 24, 25, 26, 27, 28. The fastening of the rods is performed by completely screwing the screws 106 of the coupling portions 72, in such a way as to obtain the formation of a through hole in the rods 30, 32 in the manner described below.

Figure 5:
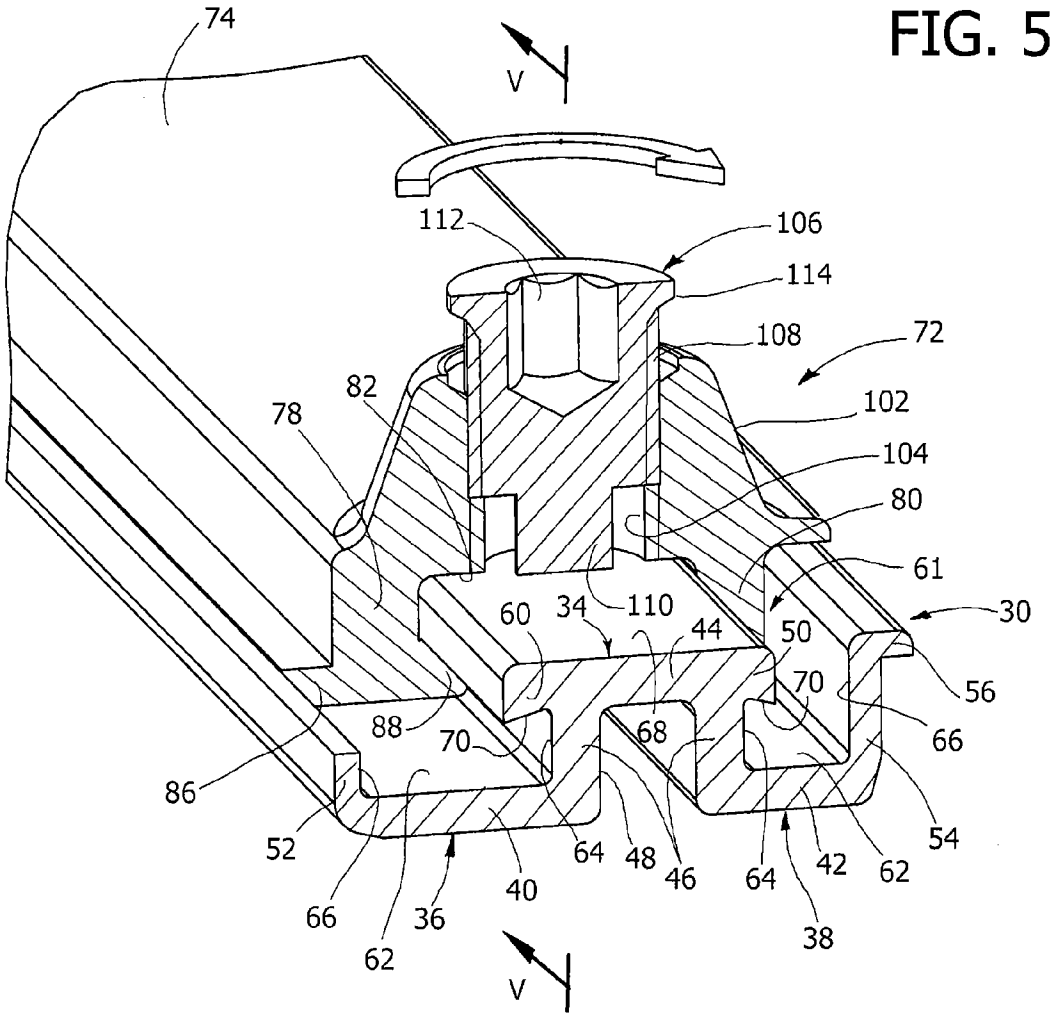
Figure 5B:
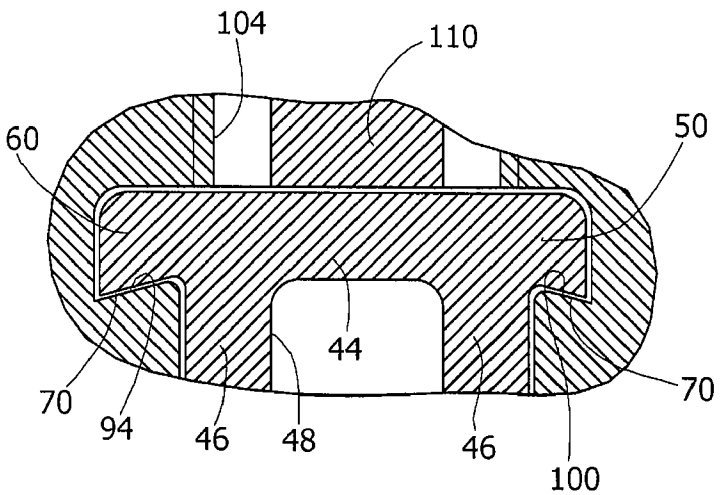
Figure 5A:
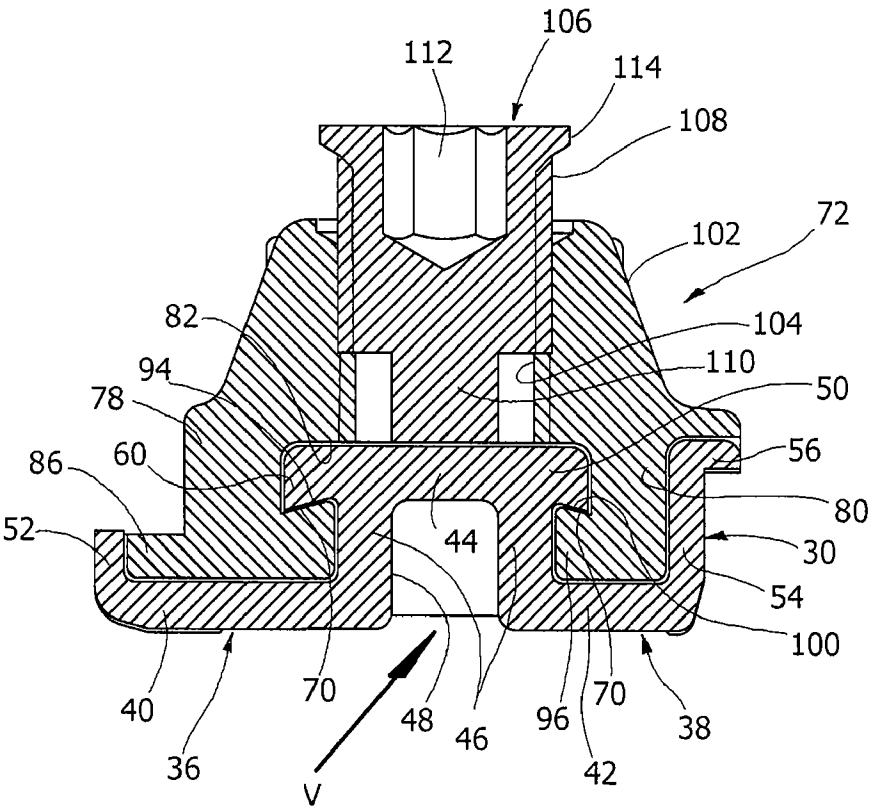

With reference to FIGS. 5, 5*a* and 5*b*, in the initial position the tip 110 of the screw 106 is slightly distanced from the upper surface 68 of the transmission rod 30, 32 and there is a play between the inclined surfaces 94,100 of the coupling portion 72 and the corresponding surfaces 70 of the transmission rod 30, 32. In this configuration, the rods 30, 32 are free to slide telescopically relative to the actuating members 24, 25, 26, 27, 28.

Beginning from the position shown in FIGS. 5, 5*a* and 5*b*, starting to tighten the screw 106 the tip 110 comes in contact with the upper surface 68 of the transmission rod 30, 32. This contact allows to eliminate the play of the telescopic coupling, bringing the inclined surfaces 94, 100 of the coupling portion 72 in contact with the corresponding surfaces 70 of the transmission rod 30, 32.

Figure 6:
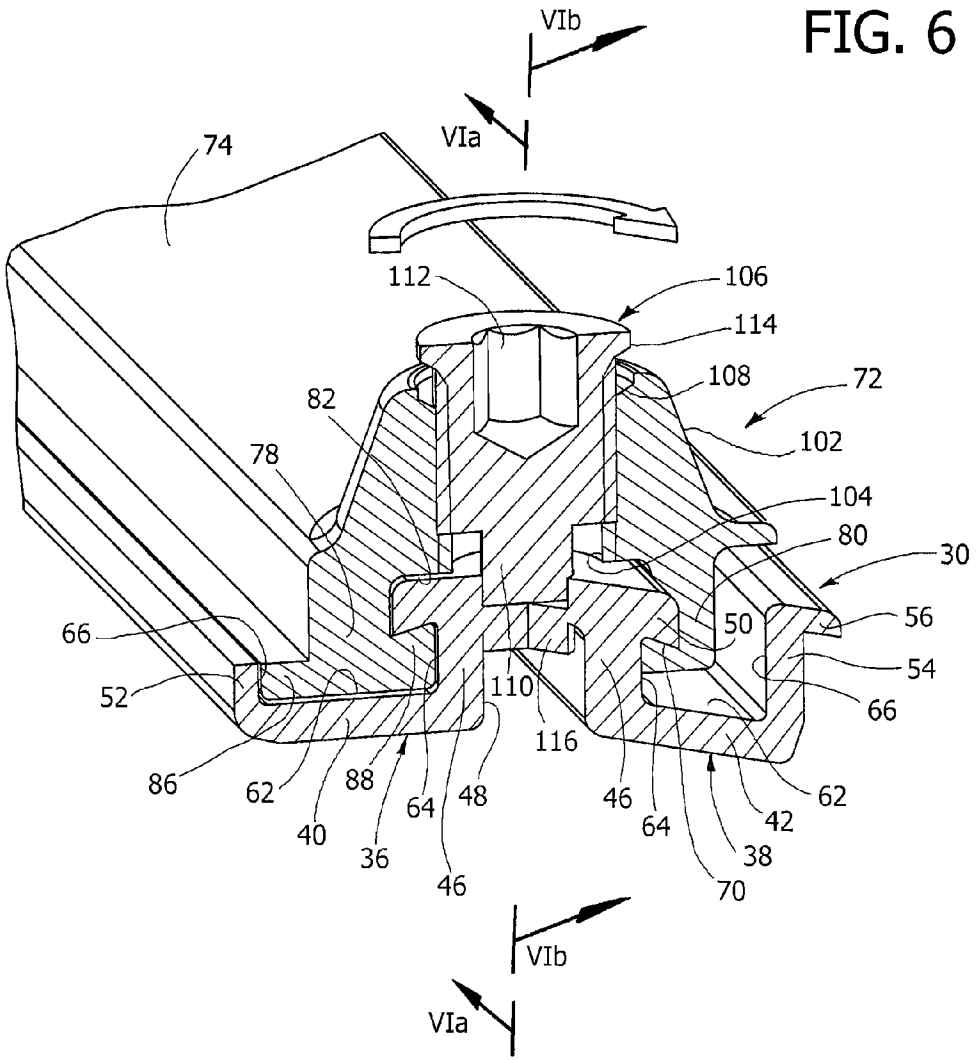
Figure 6B:
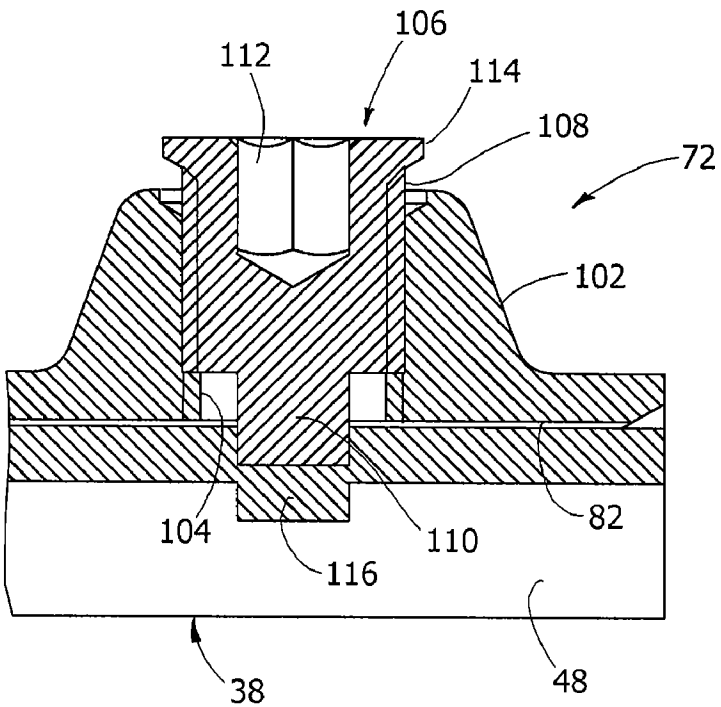
Figure 6A:
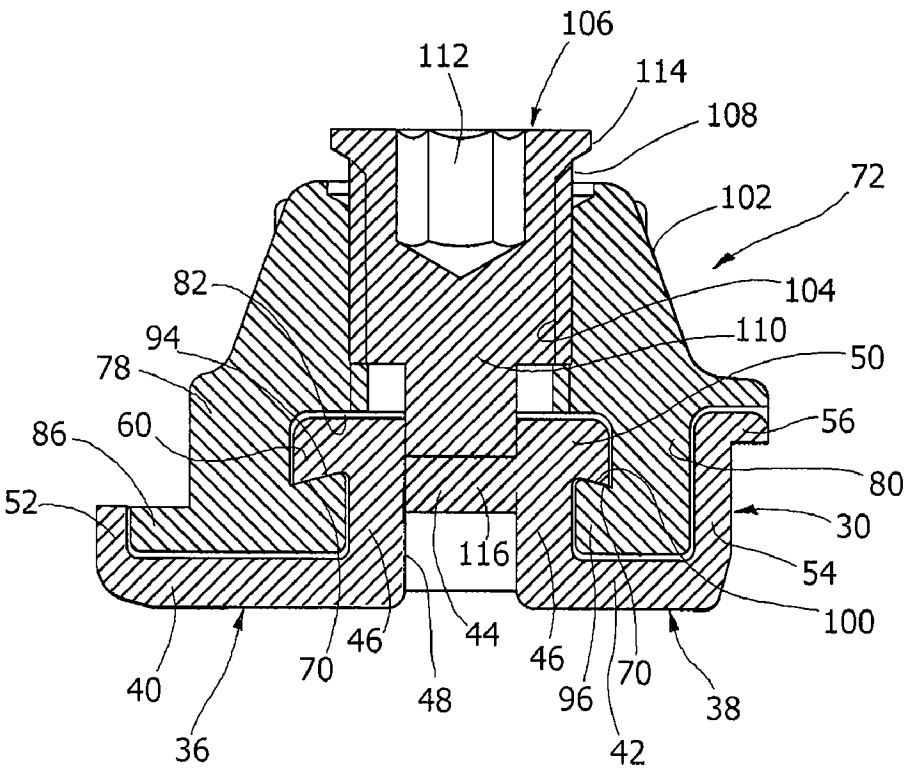

With reference to FIGS. 6, 6*a* and 6*b*, continuing to tighten the screw 106 the tip 110 starts to penetrate into the base 44 of the transmission rod 30, 32 shearing the material constituting the base 42. Said shearing forms a disc-shaped scrap 116 that projects in the channel 48 situated below the tip 110. The diameter of the tip 110 is slightly greater than the width of the groove 48, so that the scrap remains wedged in the groove 48. The tip 110 is situated with its own axis aligned to the median vertical axis of the groove 48. The shearing performed by the tip 110 of the screw 106 affects only the thickness of the base 44 between the two lateral walls of the longitudinal groove 48.

Figure 7:
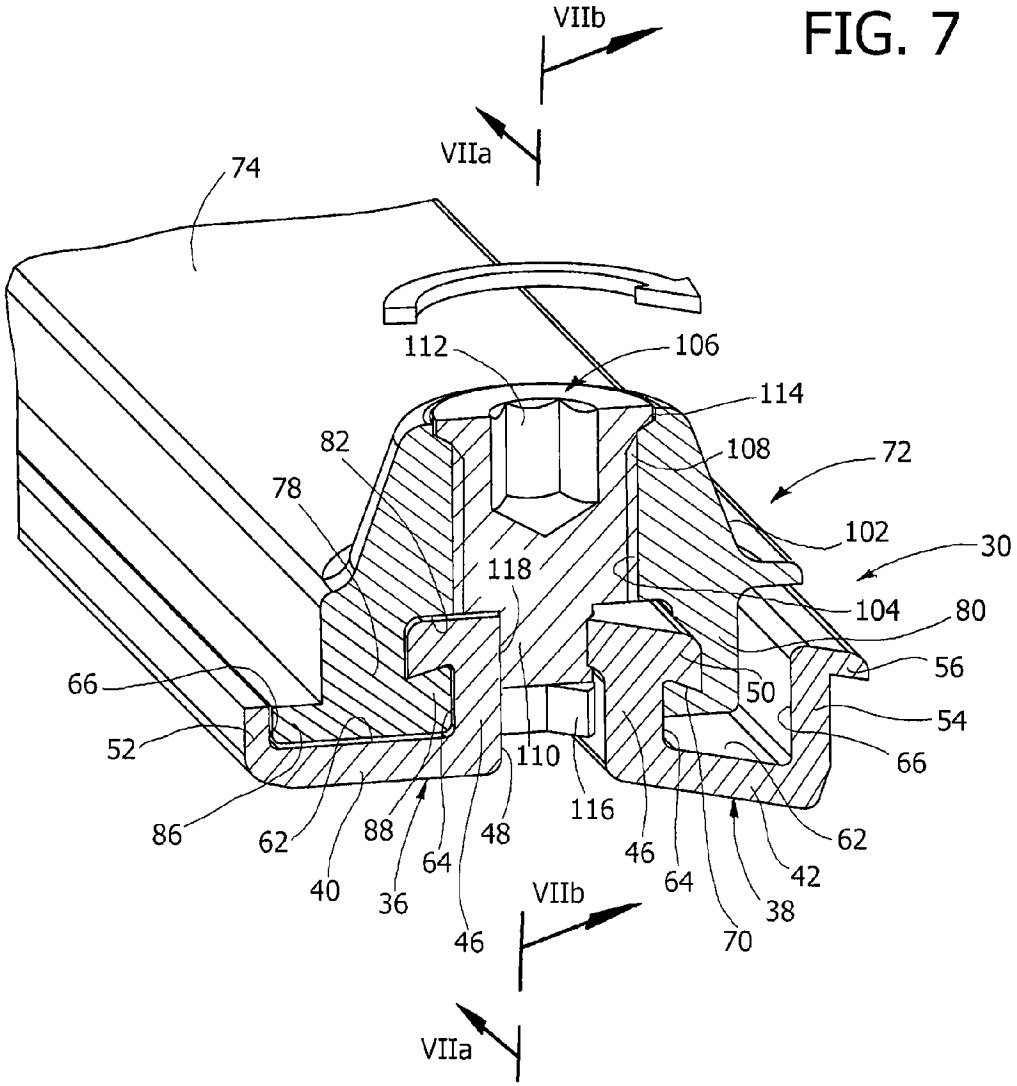
Figure 7B:
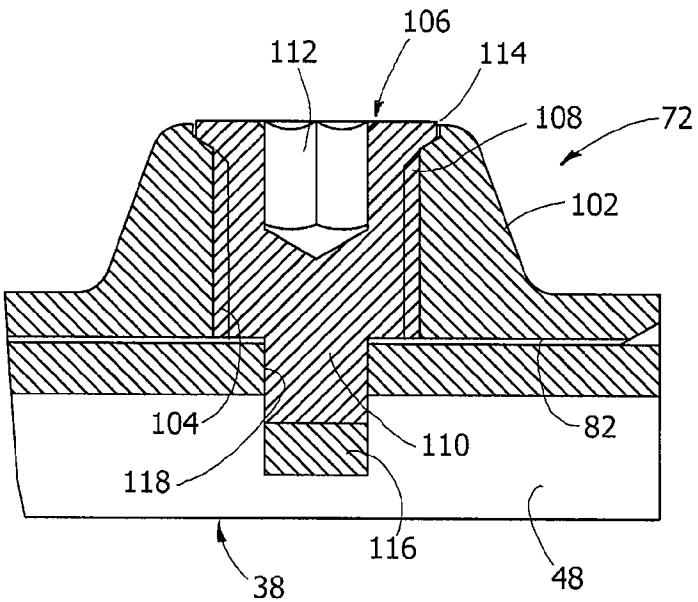
Figure 7A:
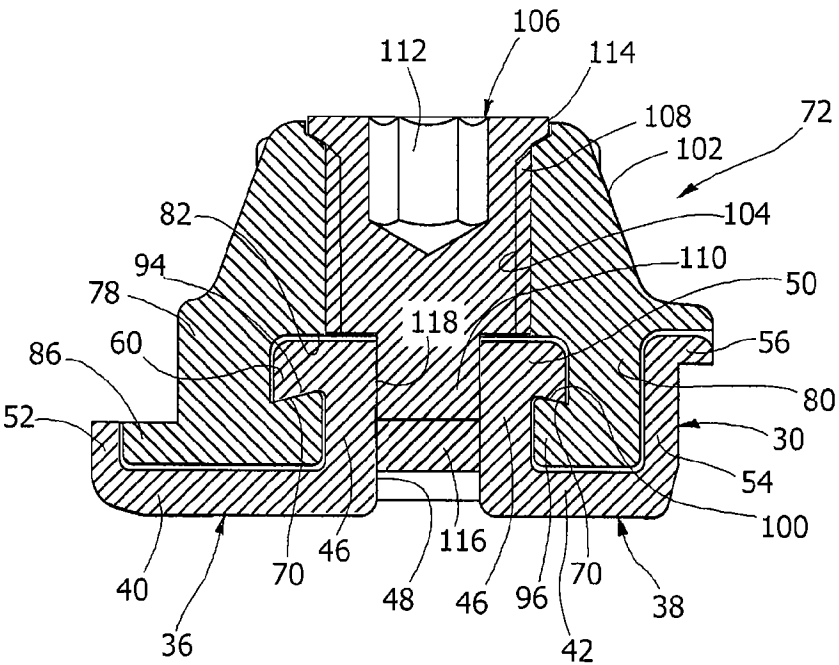

With reference to FIGS. 7, 7*a* and 7*b*, the screw 106 is screwed until the head 114 of the screw 106 abuts against the respective seat formed at the upper end of the protuberance 102. The length of the tip 110 is determined in such a way that the screw 106 performs a complete shearing of the base 44, hence forming a through hole 118 in the base 44. The scrap 116 detaches from the base 44 and is held by interference between the walls of the groove 48.

Figure 8:
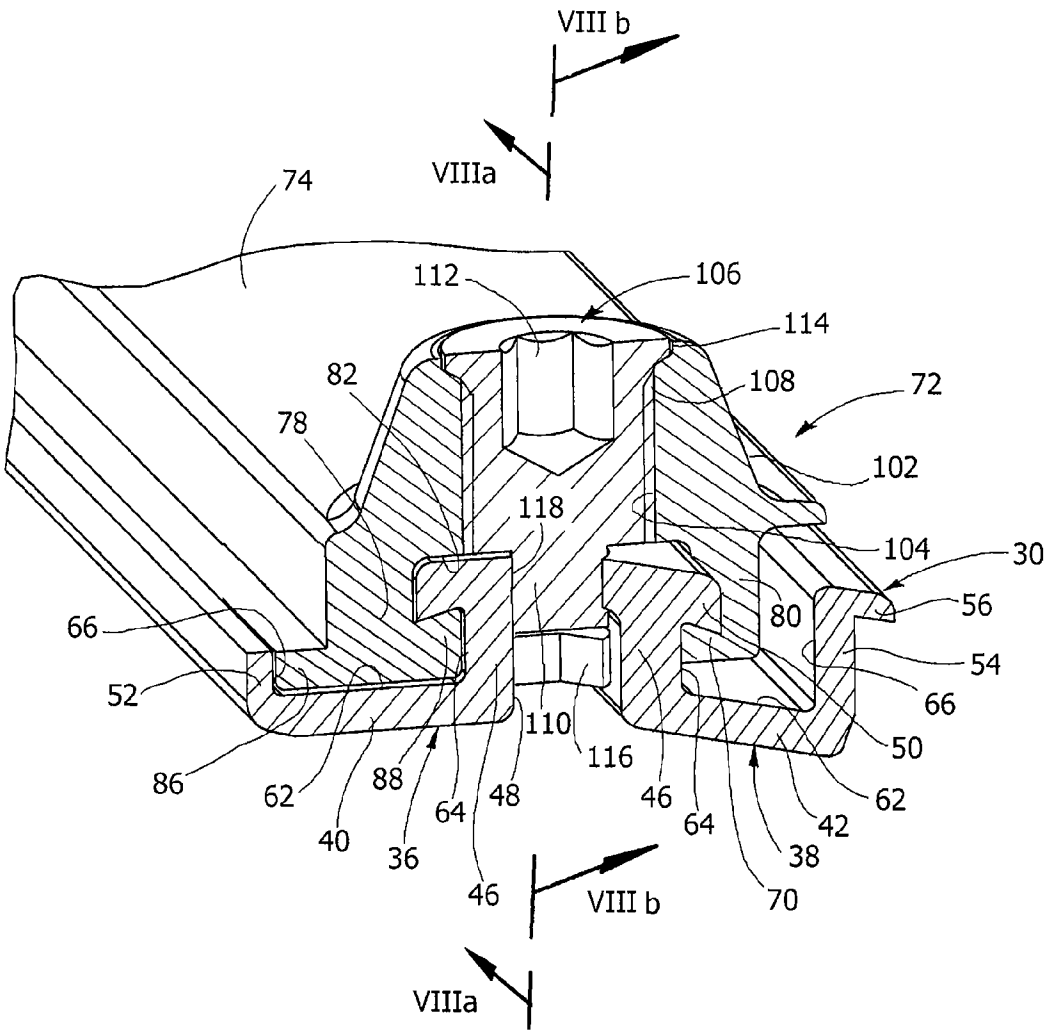
Figure 8B:
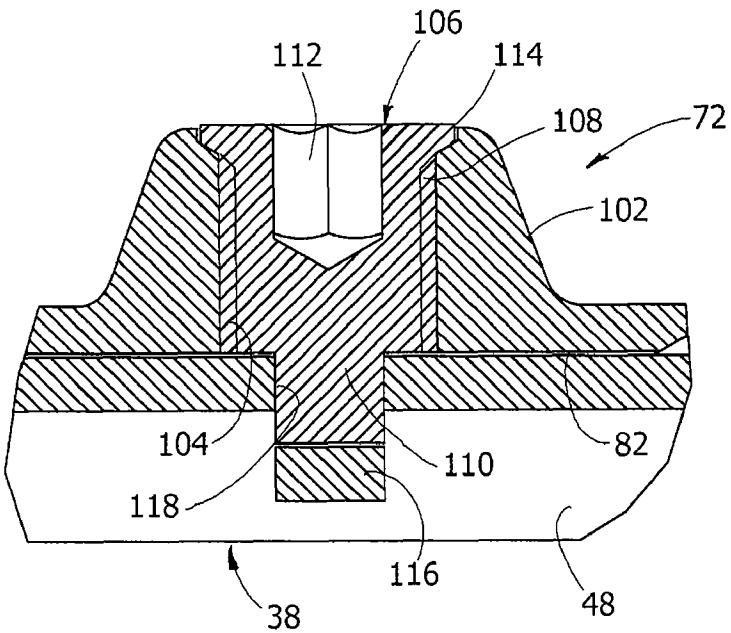
Figure 8A:
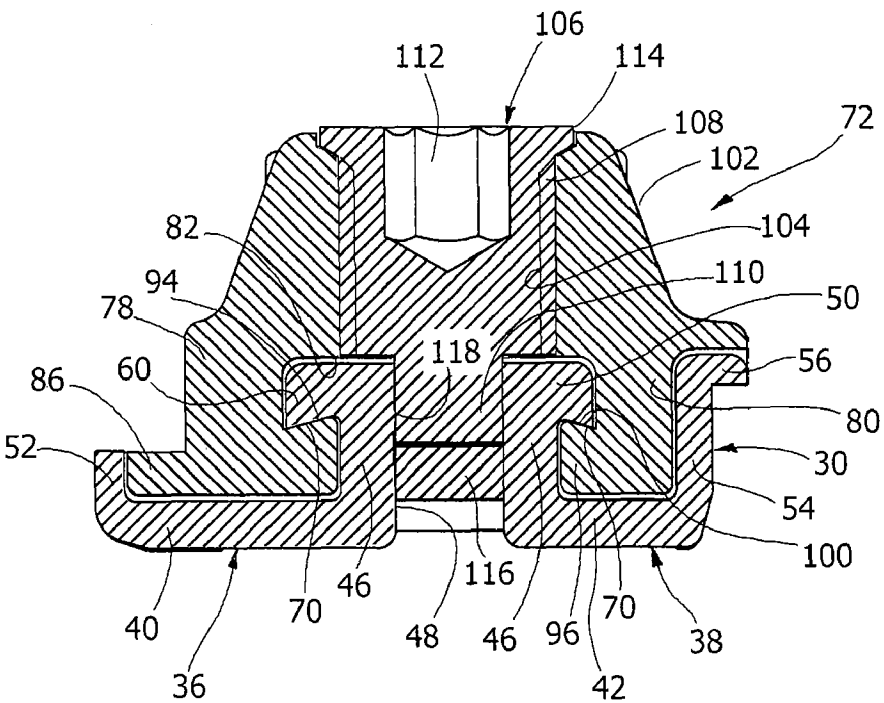

With reference to FIGS. 8, 8*a* and 8*b*, after the complete shearing of the wall of the base 44, the contact pressure between the inclined surfaces 94, 100 and 70 is eliminated. This allows to restore the initial play, eliminating the stresses and elastic deformations of the transmission rod 30, 32.

After the shearing of the scrap 116, the connection between the coupling portion 72 and the transmission rod 30, 32 no longer takes place by friction but rather by pivot-hole coupling between the tip 110 of the screw 106 and the hole 118 created by the shearing of the base 44. This provides a more secure fastening than in a friction coupling and eliminates deformations of the transmission rod that could produce interference with the walls of the groove 18 of the frame 10 creating difficulties in the sliding of the rods or the actuating members and difficulties in operating the control assembly.

The fact of forming the holes in the rods 30, 32 after mounting the rods and actuating members into the slots avoids the steps of measuring, cutting and drilling the rods. The present invention provides a better mounting precision and avoids problems due to errors or inaccuracies that can occur during the operations of measuring, cutting and drilling the rods.

While the foregoing is directed to embodiments of the present invention, other and further embodiments of the invention may be devised without departing from the basic scope thereof, and the scope thereof is determined by the claims that follow.

The invention claimed is:

1. A method for mounting a drive assembly on a door or window frame having at least one slot, the drive assembly comprising:

at least one transmission rod elongated along a longitudinal axis and having a constant cross-section in a plane orthogonal to said longitudinal axis, said transmission rod comprising a central portion and two lateral portions situated at opposite parts relative to the central portion and forming respective channel-shaped guides, the central portion having a base with a planar upper surface, the base of the central portion being connected to said lateral portions by two longitudinal ribs, the base of the central portion and the ribs forming a longitudinal groove having in a cross-section the shape of an inverted "U" that separates from each other said lateral portions, the central portion having two lateral extensions that extend laterally beyond the respective ribs, at least one actuating member having a coupling portion for coupling with said transmission rod, the coupling portion having a pre-threaded through hole and comprising a base and two feet projecting from said base, said feet slidably engaging said channel-shaped guides of the transmission rod, said feet having abutment portions for abutting said lateral extensions, a screw having a longitudinal axis, the screw including a threaded body and a tip with a non-threaded cylindrical lateral wall with a smaller diameter than the diameter of the threaded body, the threaded body being engaged in said pre-threaded hole, the tip ending with a flat wall orthogonal to the longitudinal axis of the screw, wherein in a partially screwed position of said screw said flat wall faces said planar upper surface of the transmission rod, the method comprising the steps of:

slidably engaging the feet of the actuating member with the channel-shaped guides of the transmission rod with the screw in said partially screwed position;

inserting frontally the actuating member and the transmission rod into a respective slot of the frame;

completely tightening said screw into said pre-threaded through hole thereby causing said tip to penetrate into said base of the transmission rod and forming in said base a hole with a smooth lateral wall, wherein, during tightening of said screw, said lateral extensions of the transmission rod and said abutment portions of the actuating member sustain without disengaging from each other a reaction force generated when said flat wall of the screw cuts into the base of the transmission rod.

2. The method as claimed in claim 1, wherein the hole is formed after setting the relative position between the actuating member and the transmission rod in the direction of the respective slot.

3. The method as claimed in claim 1, wherein the actuating member and the transmission rod are mutually coupled in telescopic fashion in the direction of the respective slot.

4. The method as claimed in claim 1, wherein the tip of the screw produces a scrap that is retained between two lateral portions of the transmission rod.

5. The method as claimed in claim 4, wherein the tip of the screw penetrates into a wall of the transmission rod for a depth that is equal to or greater than the thickness of the wall.

6. The method as claimed in claim 1, wherein the diameter of the tip is equal to or greater than the width of the longitudinal groove.

7. The method as claimed in claim 1, wherein the screw is screwed until reaching a contact between an arresting edge of the screw with a corresponding seat of the coupling portion.

8. The method as claimed in claim 1, wherein the threaded hole of the coupling portion is formed in a protuberance projecting from an outer surface of the coupling portion.

* * * * *